US009095224B2

(12) United States Patent
Tanaka et al.

(10) Patent No.: US 9,095,224 B2
(45) Date of Patent: Aug. 4, 2015

(54) AIR MATTRESS

(75) Inventors: Makoto Tanaka, Tokyo (JP); Rika Matsumiya, Tokyo (JP); Kenta Ohno, Tokyo (JP)

(73) Assignee: PARAMOUNT BED CO., LTD., Tokyo (JP)

( * ) Notice: Subject to any disclaimer, the term of this patent is extended or adjusted under 35 U.S.C. 154(b) by 86 days.

(21) Appl. No.: 13/519,568

(22) PCT Filed: Oct. 19, 2010

(86) PCT No.: PCT/JP2010/068303

§ 371 (c)(1),
(2), (4) Date: Aug. 1, 2012

(87) PCT Pub. No.: WO2011/096115

PCT Pub. Date: Aug. 11, 2011

(65) Prior Publication Data

US 2012/0317727 A1 Dec. 20, 2012

(30) Foreign Application Priority Data

Feb. 5, 2010 (JP) ..... 2010-024876

(51) Int. Cl.
*A47C 27/10* (2006.01)
*A47C 27/08* (2006.01)

(52) U.S. Cl.
CPC ..... *A47C 27/10* (2013.01); *A47C 27/082* (2013.01); *A47C 27/083* (2013.01); *A47C 27/08* (2013.01)

(58) Field of Classification Search
CPC ..... A47C 27/10; A47C 27/08; A47C 27/082; A47C 27/083
USPC ..... 5/710, 713, 706, 722, 726, 715
See application file for complete search history.

(56) References Cited

U.S. PATENT DOCUMENTS 4,768,249 A 9/1988 Goodwin
5,848,450 A 12/1998 Oexman et al.
(Continued)

FOREIGN PATENT DOCUMENTS

JP 06-335501 A 12/1994
JP 10-220600 A 8/1998
(Continued)

OTHER PUBLICATIONS

Chinese Office Action dated May 22, 2014 with an English translation.
(Continued)

*Primary Examiner* — Peter M Cuomo
*Assistant Examiner* — Brittany Wilson
(74) *Attorney, Agent, or Firm* — McGinn IP Law Group, PLLC

(57) ABSTRACT

Provided is an air mattress configured so that the pressure within each of bladder-shaped cells is variable, wherein the sleeping comfort of a person lying on the air mattress is not reduced.

The air mattress has a plurality of air cell groups, each of which constituted by a plurality of bladder-shaped cells and lined up with respect to the lengthwise direction of the air mattress; an air supply/release pump; an air tube linking the bladder-shaped cells and the air supply/release pump in an independent first system for each of the air cell groups and an independent second system for each of specific bladder-shaped cells out of the plurality of air cell groups; and a pressure sensor for measuring the pressure within the bladder-shaped cells for each of the first and second systems. One or a plurality of specific air cell groups is constituted by an upper section, a middle section, and a lower section of bladder-shaped cells lined up in the lengthwise direction of the air mattress; the pressure in the lower section bladder-shaped cells is controlled by the first system and the pressure in the middle section bladder-shaped cells is controlled by the second system; and the upper section bladder-shaped cells communicate with the middle section bladder-shaped cells.

17 Claims, 14 Drawing Sheets

(56) References Cited

U.S. PATENT DOCUMENTS

| | | | | |
|---|---|---|---|---|
| 6,546,580 | B2 | 4/2003 | Shimada | |
| 8,127,386 | B2 | 3/2012 | Kajiwara et al. | |
| 2002/0050010 | A1 | 5/2002 | Shimada | |
| 2004/0068801 | A1* | 4/2004 | Wilkinson | 5/713 |
| 2010/0263131 | A1 | 10/2010 | Kajiwara et al. | |

FOREIGN PATENT DOCUMENTS

| | | | |
|---|---|---|---|
| JP | 2000-506752 | A | 6/2000 |
| JP | 2000-189288 | A | 7/2000 |
| JP | 2002-136396 | A | 5/2002 |
| JP | 2002-238706 | A | 8/2002 |
| JP | 3115039 | U | 11/2005 |
| JP | 2007-144007 | A | 6/2007 |
| JP | 2008-125798 | A | 6/2008 |
| TW | 200940043 | A1 | 10/2009 |
| WO | WO 97/32509 | | 9/1997 |
| WO | WO 2009/072253 | A1 | 6/2009 |

OTHER PUBLICATIONS

International Search Report in PCT/JP2010/068303 dated Dec. 28, 2010 (English Translation Thereof).

* cited by examiner

AIR MATTRESS

TECHNICAL FIELD

The present invention relates to an air mattress, and in particular to an air mattress allowing for adjustment of air pressure within a plurality of bladder-shaped cells in independent systems.

BACKGROUND ART

Conventionally, mattresses configured so as to inflate and deflate a plurality of bladder-shaped cells as appropriate and, for example, prevent decubitus ulcers from occurring in a person lying on the air mattress or improve the contact feel felt by the person have been used as air mattresses. Patent document 1, for example, discloses an air mattress formed by a plurality of bladder-shaped air cells disposed upon a base sheet, wherein all of the air cells are divided into an upper layer and a lower layer by a divider, all of the air cells are respectively inflated or deflated in the upper layers and lower layers thereof, and decubitus ulcers are prevented from occurring in the person lying on the air mattress.

Patent document 2 discloses a technique in which four flexible sheets are layered together, the circumferential edges are bonded together, and the spaces between the flexible sheets are filled with air, thereby constituting an air mattress with three-layered air cells; and the pressure within each of the air cells is separately adjusted, thereby preventing decubitus ulcers from occurring in the person on the air mattress.

Patent document 3 discloses an air cell for an air mattress in which second and third cells smaller in diameter than a single first cell are formed above the first cell, and the first, second, and third cells are in communication with each other. By configuring the air cell in this way, the second cell and third cell increase the area contacting a person when then person lies upon the air mattress, in which a plurality of air cells is lined up, and the second cell and third cell move so as to separate from each other, thus making the air cell as a whole disinclined to collapse and reducing the contact pressure placed upon the person.

Patent document 4 discloses a technique of providing a plurality of air cells within the interior of a retaining member formed of an elastic material so as to line up in the lengthwise direction of an air mattress and adjusting the pressure within the air cells, thereby preventing decubitus ulcers from occurring in a person lying on the air mattress.

Patent document 5 discloses a technique of preventing repelling force from being placed by a mattress upon a location of a person lying on the air mattress at which decubitus ulcers have occurred, and discloses lining up multiple cuboid air cells in the lengthwise direction and widthwise direction of an air mattress, attaching a magnetic marker to a location of a person at which decubitus ulcers have occurred, detecting the position of the marker using a magnetic sensor provided in each of the air cells, and reducing the pressure in the air cells corresponding to the position of the detected marker.

BACKGROUND ART LITERATURE

Patent Literature

Patent Document 1: Registered Japanese Utility Model No. 3115039

Patent document 2: Japanese Laid-Open Patent Application No. 2002-136396

Patent document 3: Japanese Laid-Open Patent Application No. 2008-125798

Patent document 4: Japanese Laid-Open Patent Application No. 2000-189288

Patent document 5: Japanese Laid-Open Patent Application No. 2007-144007

DISCLOSURE OF THE INVENTION

Problems the Invention is Intended to Solve

However, the following problems are present in the above described prior art. Because the air mattress of patent document 1 is configured so as to inflate and deflate all of the air cells in both the upper layers and lower layers thereof, comfort is reduced due to, for instance, a large repelling force being placed by the mattress upon a specific location of the person lying on the air mattress; for instance, the buttock area.

In the air mattress of patent document 2 as well, because each of the first, second, and third cells is set to identical pressures, comfort is reduced due to, for instance, a large repelling force being placed by the mattress upon a specific location of the person lying on the air mattress; for instance, the buttock area, as in the case of the technique of patent document 1. Also, in the air cell of patent document 2, an upper surface and a lower surface are bonded using a plurality of punctate adhered parts, thereby forming a plurality of convexities; however, when the air cell is configured in this way, if the adhered parts happen to come apart, the air cell swells up into a single large bladder shape, and stops functioning as an air mattress function.

Problems are presented in the air cell of patent document 3 in that it is of a complex structure, has many parts where adhesion between members occurs, and entails high manufacturing costs.

In the air mattress of patent document 4, because the pressure within all of the bladder-shaped cells is set to a fixed value, comfort is reduced, as with the techniques of patent documents 1 and 2.

In the air mattress of patent document 5, not only is it necessary to provide multiple air cells, resulting in a complicated structure, but it is also necessary to provide a magnetic sensor for each of the air cells, increasing manufacturing costs.

An object of the present invention is to provide a mattress configured so that the pressure within each of bladder-shaped cells is variable, wherein the comfort of a person lying on the air mattress is not reduced.

Means for Solving the Problems

The air mattress according to the present invention has a plurality of air cell groups, each of which constituted by a plurality of bladder-shaped cells and lined up in the lengthwise direction of the air mattress, an air supply/release pump, an air tube connecting the bladder-shaped cells and the air supply/release pump in one or a plurality of independent first systems for each of the air cell groups out of the air cell groups and one or a plurality of independent second systems for each of specific bladder-shaped cells out of the plurality of air cell groups, and a controller for controlling air supply/release by the air supply/release pump with respect to the first system and second system; one or a plurality of specific air cell groups out of the plurality of air cell groups is respectively constituted by an upper section, a middle section, and a lower section of bladder-shaped cells lined up in the lengthwise direction of the air mattress; the pressure in the lower section bladder-shaped cells is controlled by the first system; the pressure in the middle section bladder-shaped cells is controlled by the second system; and the upper section bladder-shaped cells communicate with the middle section bladder-shaped cells therebeneath.

In the air mattress described above, the plurality of air cell groups is lined up corresponding to, for example, at least a head area, shoulder area, back area, buttock area, thigh area, knee area, and heel area of a person lying on the air mattress; and the specific air cell groups are air cell groups corresponding to the back area, buttock area, and thigh area.

Also, for example, at least a side surface of each of the upper section and middle section bladder-shaped cells is formed in an arcuate shape, and the radius of curvature of the arcuately shaped parts of the upper section bladder-shaped cells is smaller than the radius of curvature of the arcuately shaped parts of the middle section bladder-shaped cells.

In the air mattress described above, it is preferable that the controller perform a control so that the pressure in the lower section bladder-shaped cells is greater than that in the middle section bladder-shaped cells.

The controller performs a control so that the pressure in at least, for example, the air cell groups corresponding to the head area of the person lying on the air mattress out of the air cell groups is maintained at a fixed level, the bladder-shaped cells of the air cell groups corresponding to the heel area are inflated or deflated at a fixed interval, and the pressure in the air cell groups corresponding to the back area and thigh area is greater than the pressure in the air cell groups corresponding to the buttock area.

In this case, the bladder-shaped cells of the air cell groups corresponding to the head area and heel area, as well as the lower section bladder-shaped cells of the air cell groups corresponding to the back area, buttock area, and thigh area, are connected to the first system via the air tube; and in order to set the pressure within the bladder-shaped cells to which air is supplied by the first system to a set target value, the controller begins supplying air using the air supply/release pump to the system when the value measured by the pressure sensor is reduced below the set target value and a period during which the difference between the measured value and the set target value is 5% or more is four seconds or more, and stops supplying air using the air supply/release pump when the value measured by the pressure sensor becomes equal to or greater than the set target value.

Also, for example, the second systems are constituted by two or more systems; each of the bladder-shaped cells in the air cell groups corresponding to the shoulder area and knee area, as well as the upper section bladder-shaped cells in the air cell groups corresponding to the back area, buttock area, and thigh area, is connected to one of the second systems via the air tubes; and a control can be performed so that inflation and deflation can be repeated in order within each of the air cell groups for each of the systems.

Effects of the Invention

The air mattress according to the present invention has first and second air intake/release systems, and in specific air cell groups, the pressure in lower section bladder-shaped cells is controlled by the first system, the pressure in middle section bladder-shaped cells is controlled by the second system, and upper section bladder-shaped cells communicate with the middle section bladder-shaped cells therebeneath. It is thereby possible to separately control the pressure in each of the air cell groups, and furthermore to control the pressure respectively in upper section and middle section bladder-shaped cells and lower section bladder-shaped cells via independent systems for specific air cell groups, not only allowing pressure to be controlled according to the location on the body of the person lying on the air mattress, but also allowing the pressure in upper section and middle section bladder-shaped cells in parts of specific air cell groups to be set to a pressure such that sleeping comfort is not reduced while the body of the person is in a state of being stably supported by the lower section bladder-shaped cells. Thus, in accordance with the air mattress according to the present invention, the sleeping comfort of the person lying on the air mattress is not reduced.

BEST MODE FOR CARRYING OUT THE INVENTION

Figure 1:
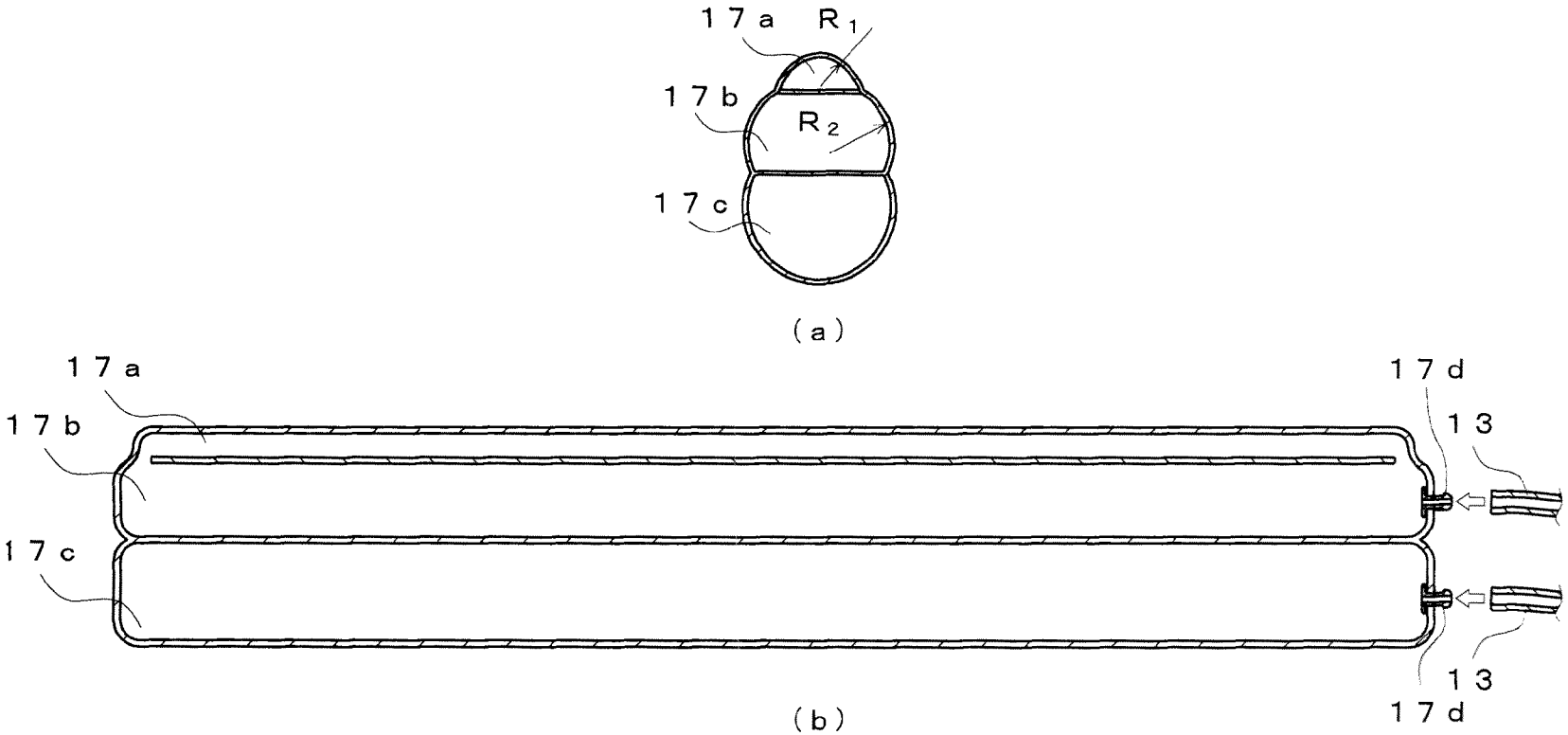
FIG. 1 shows (a) a lateral cross-sectional view of a three-sectioned bladder-shaped cell in an air mattress according to an embodiment of the present invention, and (b) a longitudinal cross-sectional view of the same.
Figure 2:
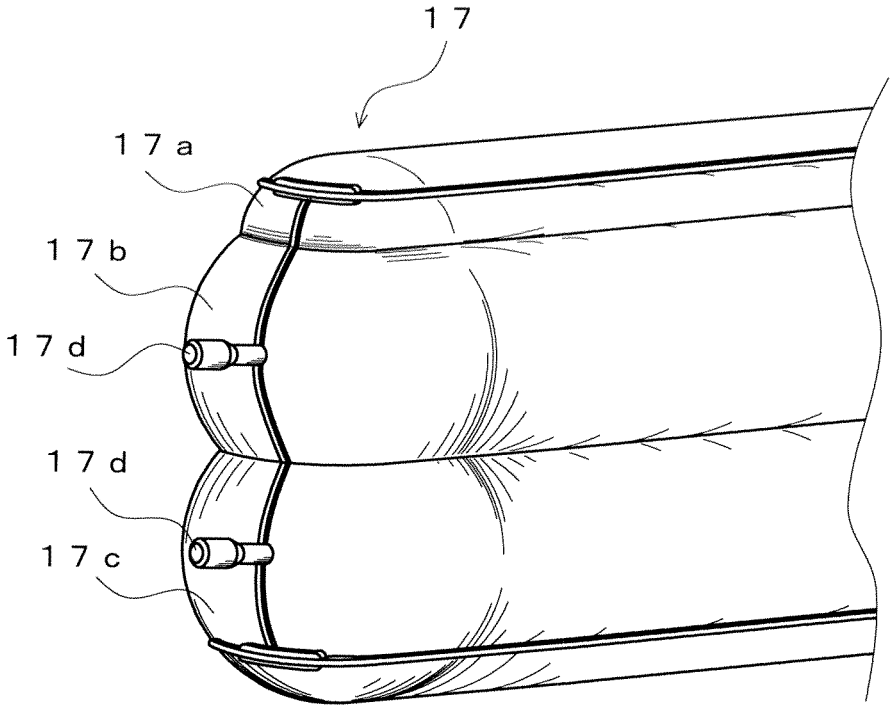
FIG. 2 is a perspective view of a three-sectioned bladder-shaped cell in the air mattress according to the embodiment of the present invention.
Figure 3:
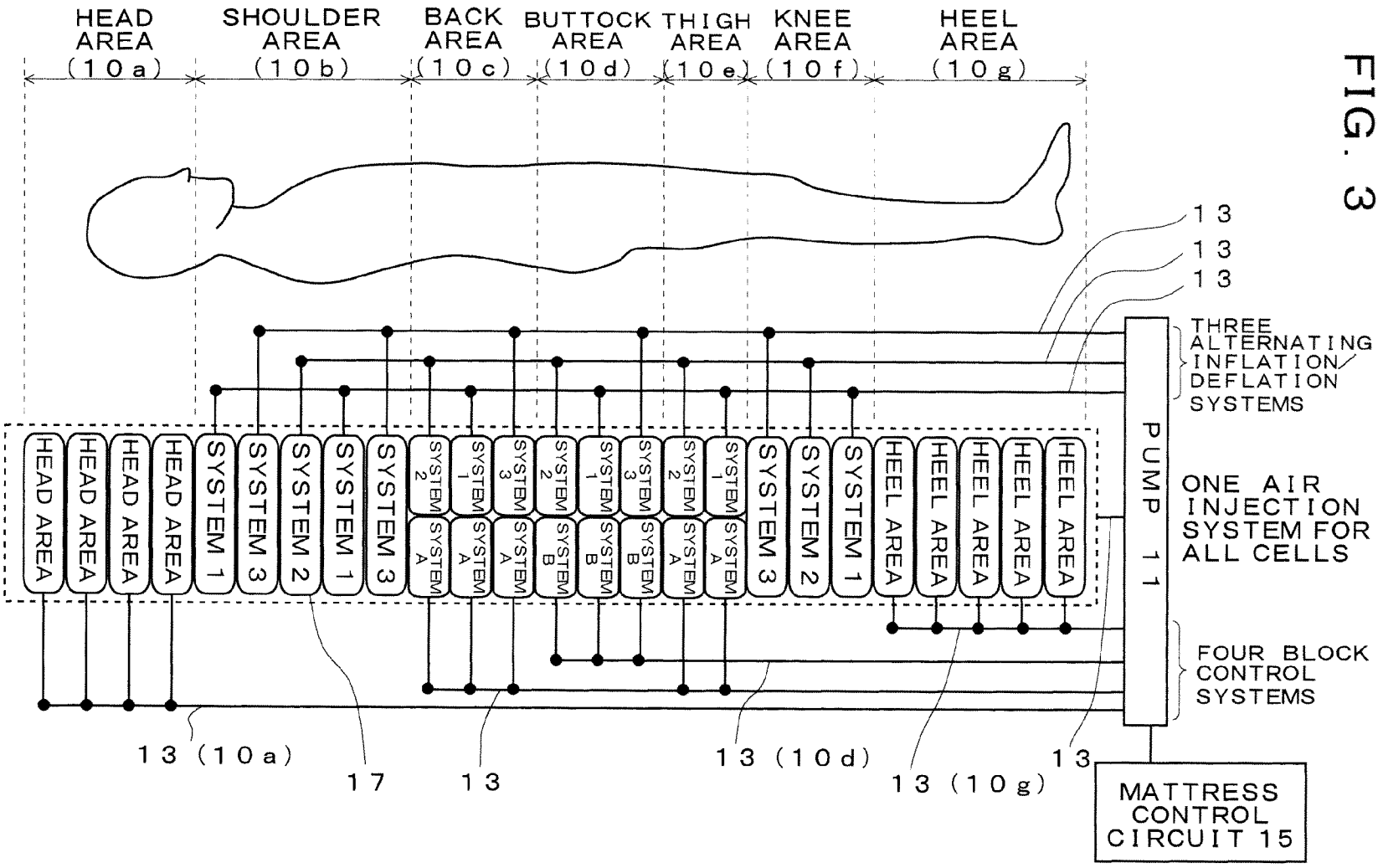
FIG. 3 is a schematic view of air supply/release systems for each of bladder-shaped cells of the air mattress according to the embodiment of the present invention.
Figure 4:
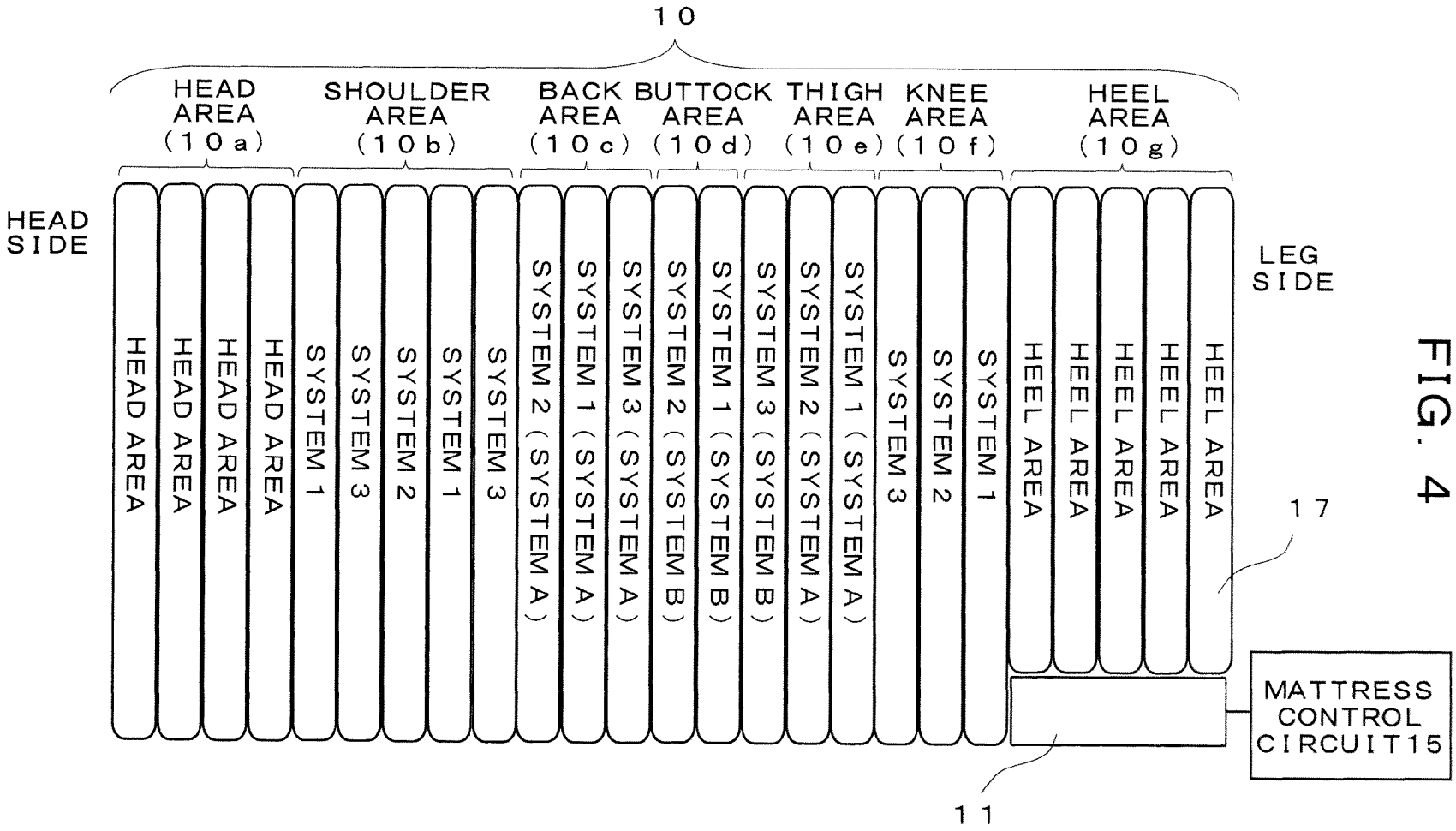
FIG. 4 is a plan view of the disposition of each of the bladder-shaped cells and an air supply/release pump of the air mattress according to the embodiment of the present invention.
Figure 5:
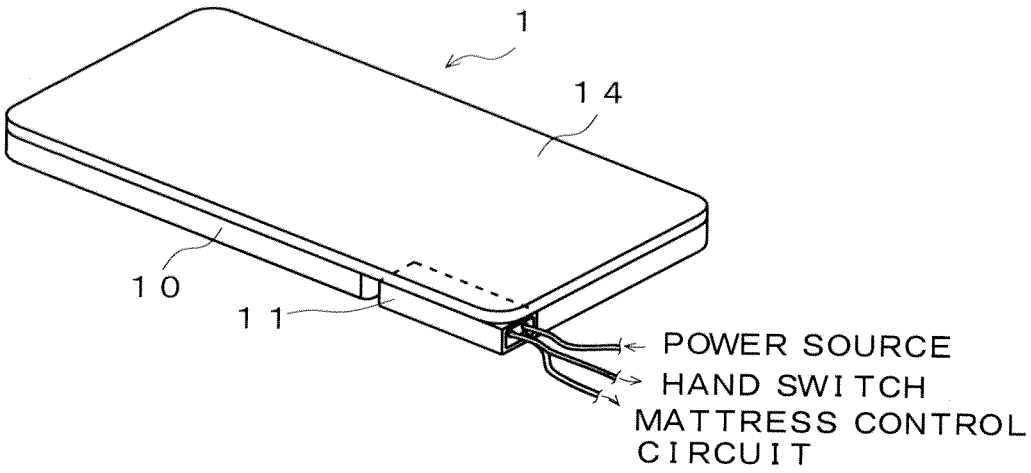
FIG. 5 is a perspective view of the air mattress according to the embodiment of the present invention.
Figure 6:
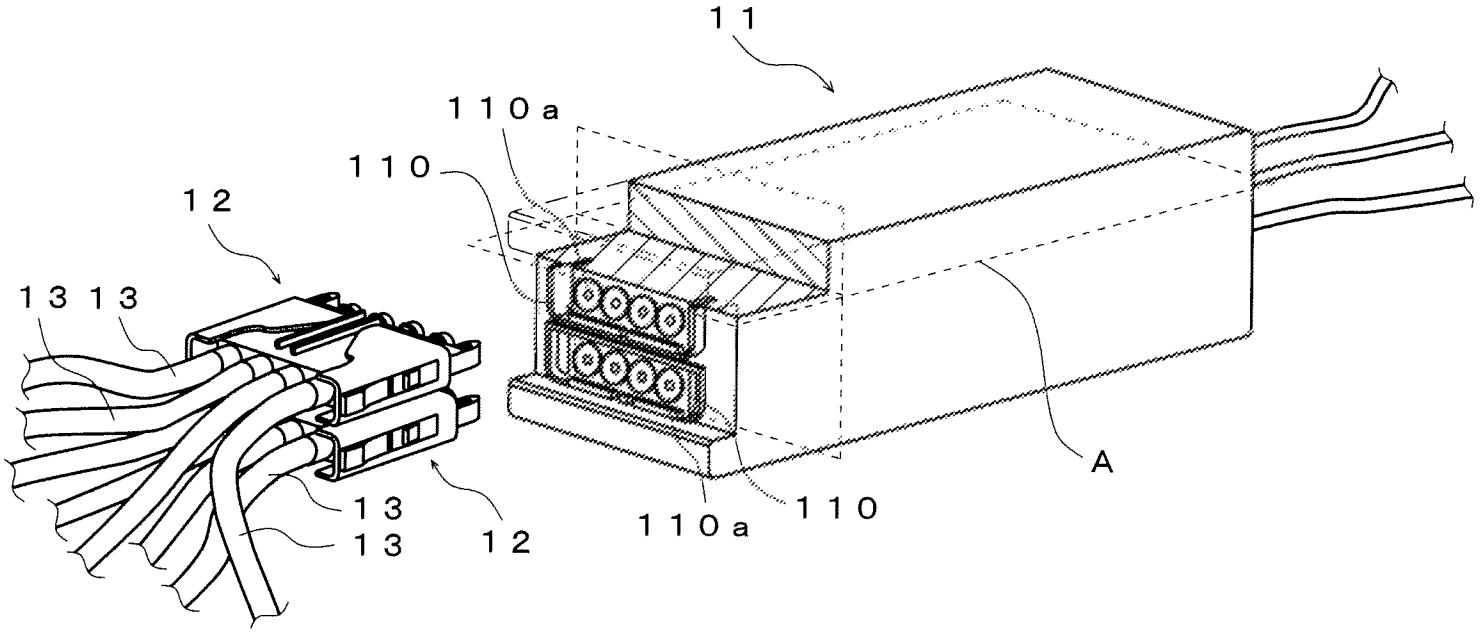
FIG. 6 is a perspective view of the air supply/release pump and a connector of the air mattress according to the embodiment of the present invention.
Figure 7:
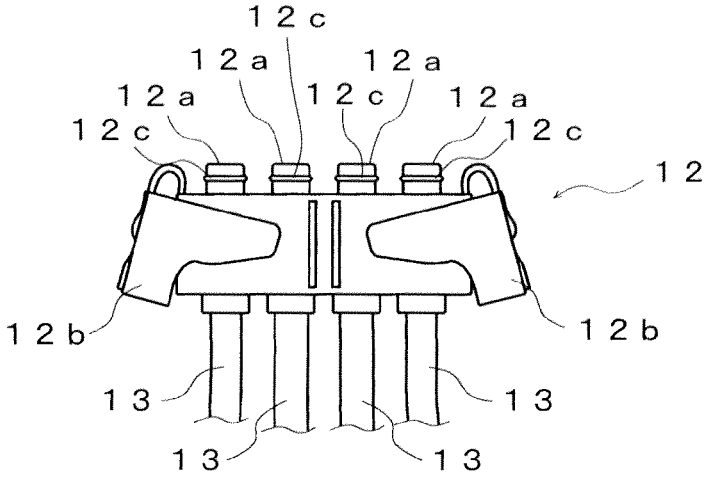
FIG. 7 is a plan view of the air tube-side connector of the air mattress according to the embodiment of the present invention.
Figure 8:
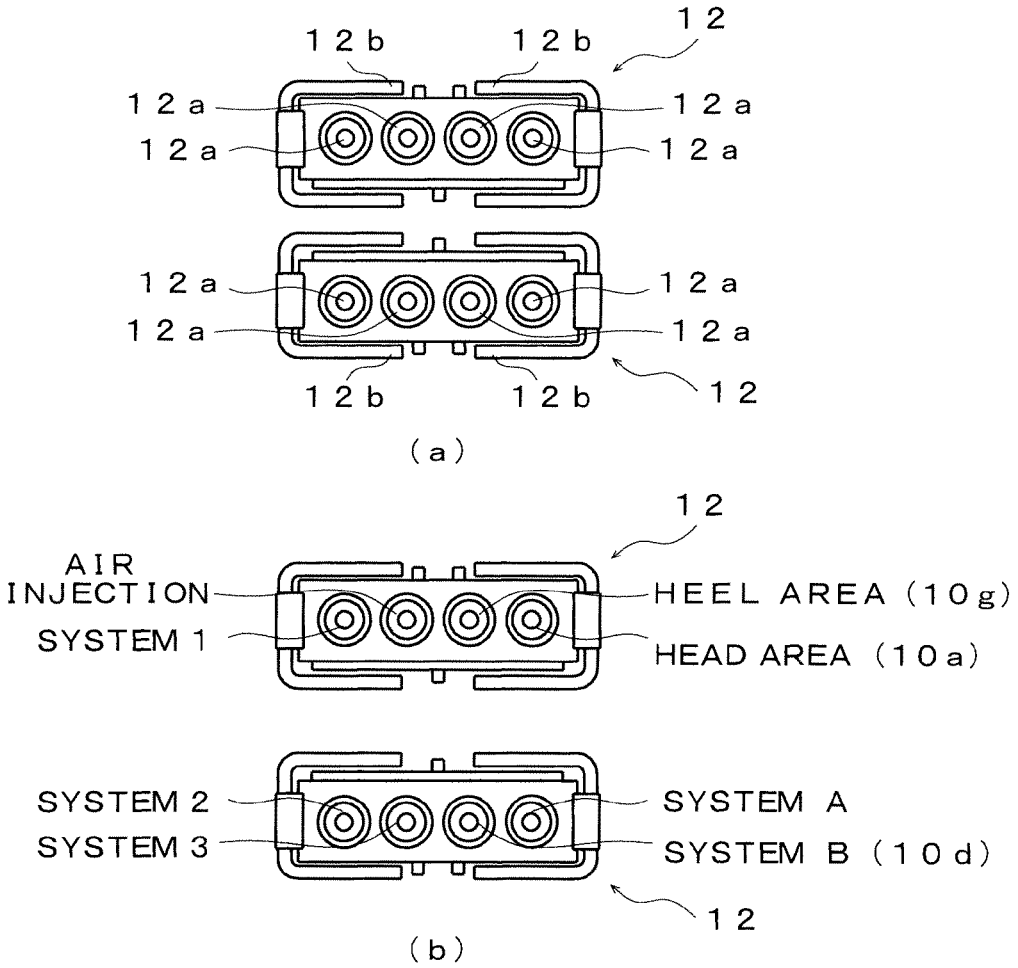
FIGS. 8(*a*) and 8(*b*) are views of the air tube-side connector of an air mattress according to the embodiment of the present invention as seen from a mating surface side thereof.
Figure 9:
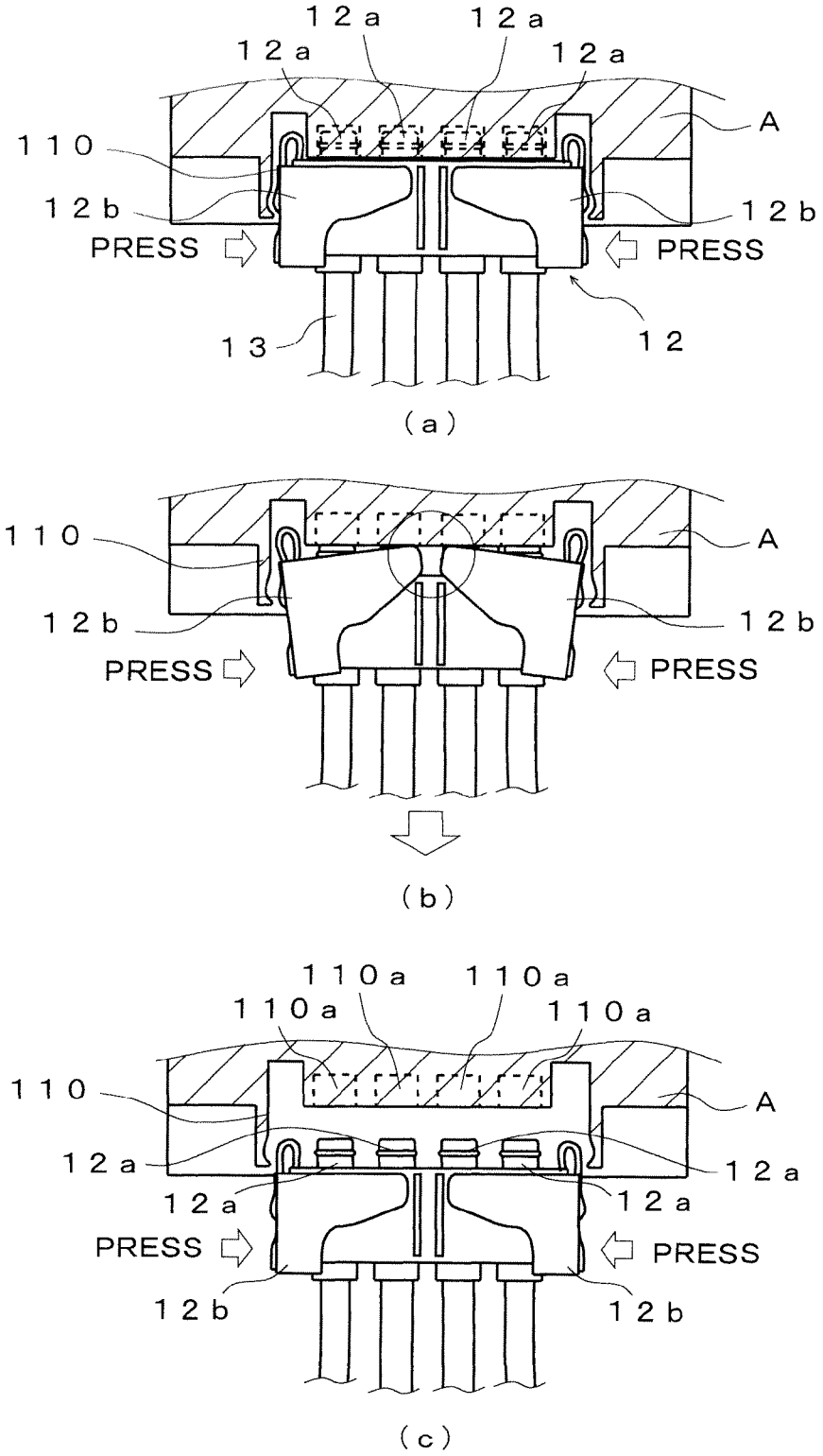
FIG. 9(*a*) through 9(*c*) are partial plan views illustrating a process of removing a connector of the air mattress according to an embodiment of the present invention.

There follows a detailed description of an air mattress according to an embodiment of the present invention with reference to the attached drawings. FIG. 1(*a*) is a lateral cross-sectional view of a three-sectioned bladder-shaped cell in an air mattress according to an embodiment of the present invention and FIG. 1(*b*) is a longitudinal cross-sectional view of the same. FIG. 2 is a perspective view of a three-sectioned bladder-shaped cell. FIG. 3 is a perspective view of the air mattress according to the embodiment of the present invention, FIG. 4 is a plan view of the disposition of individual bladder-shaped cells and an air supply/release pump of the air mattress according to the embodiment of the present invention, and FIG. 5 is a perspective view of the air mattress according to the embodiment of the present invention. FIG. 6 is a perspective view of the air supply/release pump and a connector of the present embodiment; FIG. 7 is a plan view of an air tube-side connector of the present embodiment; FIGS. 8(*a*) and 8(*b*) are views of the air tube-side connector of the present embodiment as seen from a mating surface side thereof; and FIG. 9 is a partial plan view illustrating a process of removing the connector of the air mattress according to the present embodiment, and is a cross-sectional view along plane A in FIG. 6.

First, the configuration of the air mattress according to the present embodiment will be described. As shown in FIGS. 3 through 5, the air mattress 1 according to the present embodiment is provided with a plurality of air cell groups 10 each of which being configured using a plurality of bladder-shaped cells 17, an air supply/release pump 11, an air tube 13 connecting the bladder-shaped cells 17 of each of the air cell groups 10 to the air supply/release pump 11, and a mattress control circuit 15 for controlling air supply/release to each of the air cell groups 10 by the air supply/release pump. In the present embodiment, as shown in FIGS. 3 through 5, the plurality of air cell groups 10, air tube 13, and air supply/release pump 11 constitute an integrated whole.

As shown in FIG. 4, each of the bladder-shaped cells 17 of the plurality of air cell groups 10 is a rod-shaped cell extending in, for example, the widthwise direction of the air mattress 1, and the plurality of bladder-shaped cells 17 is lined up in the lengthwise direction of the air mattress to constitute the main body of the air mattress. As shown in FIG. 3 and FIG. 4, the plurality of bladder-shaped cells 17 is disposed lined up with respect to the lengthwise direction of the air mattress 1 so that a plurality thereof corresponds to each of the head area, shoulder area, buttock area, thigh area, knee area, and heel area of a person lying on the air mattress 1; and constitute air cell groups 10*a* through 10*e* corresponding to each of the locations of the body of the person. In the present embodiment, as shown in FIG. 3, the bladder-shaped cells 17 corresponding to the back area, buttock area, and thigh area of a person are divided into upper sections and lower sections, and the air pressure for each is controlled by separate systems. Each of the bladder-shaped cells 17 is, for example, formed by stitching together resin material such as nylon fibers or the like, and bladder-shaped cells 17 disposed adjacent to one another are fixed together by, for example, being stitched together. The fixing together of bladder-shaped cells 17 may also be performing using, for example, an adhesive. In this way, the air mattress 1 supports the body of the person lying on the mattress by having the plurality of rod-shaped cells extending in the widthwise direction of the air mattress 1 be lined up in the lengthwise direction of the air mattress, and the interior of each of the bladder-shaped cells 17 be filled with air. By adjusting the air pressure within the bladder-shaped cells 17 according to each of the locations of the body, it is possible, for example, to cause the pressure within the bladder-shaped cells for the back area and the thigh area to be greater than that of the pressure within the bladder-shaped cells for the buttock area, thus enabling dispersion of body pressure. Each of the plurality of bladder-shaped cells 17 is provided in at least one location with an air supply/release terminal for connecting to the air tube 13. In the present embodiment, each of the bladder-shaped cells is provided with an air supply/release terminal 17*d* at one location, and each of the bladder-shaped cells is configured so as to be capable of being inflated and deflated by connecting the air tube 13 to the air supply/release terminal and supplying air to or releasing air from the bladder-shaped cell via the air tube 13 of each of the systems. The air tube 13 used is preferably, for example, manufactured from a resin such as vinyl chloride.

Each of the bladder-shaped cells 17 of air cell groups 10*c* through 10*e* corresponding to the back area, buttock area, and thigh area of the person on the mattress are divided into, as shown for example in FIG. 1 and FIG. 2, upper bladder-shaped cells and lower bladder-shaped cells 17*c*, and the upper bladder-shaped cells and lower bladder-shaped cells 17*c* are fixed together using, for example, an adhesive. A divider member of, for example, nylon fibers or the like is further provided within the upper bladder-shaped cells, which are divided into upper section bladder-shaped cells 17*a* and middle section bladder-shaped cells 17*b*. As shown in FIG. 1(*b*), the divider member is disposed, for example, at parts other than the two ends of the boundary between the upper section bladder-shaped cells 17*a* and the middle section bladder-shaped cells 17*b*, and the upper section bladder-shaped cells 17*a* and the middle section bladder-shaped cells 17*b* are connected at the two ends with respect to the lengthwise direction of the bladder-shaped cells. A configuration is thus obtained in which it is possible to control pressure so that the pressure in the interior of the upper section bladder-shaped cells 17*a* and the pressure in the interior of the middle section bladder-shaped cells 17*b* becomes equal.

As shown in FIG. 1(*a*), at least a side surface of each of the upper section bladder-shaped cells 17*a* and the middle section bladder-shaped cells 17*b* is formed in an arcuate shape. The radius of curvature R1 of the arcuately shaped parts of the upper section bladder-shaped cells 17*a* is smaller than the radius of curvature R2 of the arcuately shaped parts of the middle section bladder-shaped cells. By setting the radii of curvature of the arcuately shaped parts of the upper section and middle section bladder-shaped cells 17*a*, 17*b* in this way, it is possible to reduce the surface tension in the surface of the upper section bladder-shaped cells 17*a*, thereby yielding a softer contact feel when in contact with a person. Specifically, the internal pressure and surface tension of a bladder-shaped body can generally be expressed by the following formula, and when internal pressure is fixed, the surface tension is correlated to the radius of curvature of the bladder-shaped body. As such, the surface tension of the upper section bladder-shaped cells 17*a*, whose sides have a small radius of curvature, is smaller than the surface tension in the middle section bladder-shaped cells 17*b*, yielding a soft contact feel when contacted. In the following formula, p represents internal pressure, R represents radius of curvature, and γ represents surface tension.

$$\Delta p = 2\gamma / R \quad \text{(Formula 1)}$$

In the present embodiment, as shown in FIG. 3, the plurality of bladder-shaped cells in an air cell group 10*a*, which corresponds to the head area of a person lying on the air mattress, is connected to a shared air tube 13 so that air is supplied or released through an independent air supply/release system, and the plurality of bladder-shaped cells in an air cell group 10*g*, which corresponds to the heel area, is connected to a shared air tube 13 so that air is supplied or released through a single independent air supply/release system. Furthermore, out of the bladder-shaped cells of an air cell group 10*c* corresponding to the back area of the person lying on the air mattress, the bladder-shaped cells in a lower section are connected to an air tube 13 shared with the bladder-shaped cells in a lower section of an air cell group 10*e* corresponding to the thigh area, and are configured so that air is supplied or released through a single independent air supply/release system (system A). Likewise, the bladder-shaped cells in a lower section of an air cell group 10*d* corresponding to the buttock area is connected to a common air tube 13 so that air is supplied or released through a single independent air supply/release system (system B). Furthermore, in the present embodiment, a plurality of bladder-shaped cells of an air cell group 10*b* corresponding to a shoulder area of the person lying on the air mattress is connected to one of three independent air supply/release systems (system 1, system 2, and system 3) via an air tube 13, and is configured so that independent air supply or release is performed for each. Likewise, the pluralities of bladder-shaped cells of air cell groups 10*c* through 10*f* corresponding to the back area (upper section), buttock area (upper section), thigh area (upper section), and knee area are connected to one of three independent air supply/release systems (system 1, system 2, and system 3) via an air tube 13, and are configured so that independent air supply or release is performed for each. As shown in FIG. 3 and FIG. 4, the bladder-shaped cells of each of the three air supply/release systems are disposed in alternation in the order of system 1, system 3, system 2, system 1, system 3 . . . from the shoulder area to the knee area. Each of the bladder-shaped cells in the same air supply/release system (system 1, system 2, or system 3) is connected to a common air tube 13. In the present embodiment, an air injection tube 13 for supplying air to one independent system is laid on a lower surface of the mattress, and is configured so that, by supplying air to the air injection tube, air is ejected from a plurality of injection holes provided on an outer surface of the air injection tube, enabling moisture to be removed from the mattress. Specifically, the present embodiment is provided with four air supply/release systems for controlling blocks for the head area, heel area, buttock area (lower section), and back area (lower section) and thigh area (lower section) of the mattress user; with three air supply/release systems—system, system 2, and system 3—for alternating inflation/deflation; and with one air supply system for injecting air, for a total of eight air supply/release systems. It is thereby possible to separately adjust the air pressure within the bladder-shaped cells according to the part of the body, thus dispersing body pressure. In the present embodiment, the pressure within air cell group 10*a* corresponding to the head area of the person lying on the air mattress is maintained at a fixed level, the bladder-shaped cells 10*g* of the air cell group corresponding to the heel area are inflated or deflated at a fixed interval, and the pressure within air cell groups 10*c*, 10*e* corresponding to the back area and the thigh area is set to be greater than that of air cell group 10*d* corresponding to the buttock area. A pressure sensor for measuring internal pressure is provided for each of the bladder-shaped cells 17 of the present invention, and is configured so that the value measured by the pressure sensor is outputted to a bed control circuit described below. In this case, a pressure sensor may be provided for all of the bladder-shaped cells 17, or a shared pressure sensor may be provided for one air supply/release system.

As shown in FIG. 4, out of the bladder-shaped cells 17 of the plurality of air cell groups 10, the bladder-shaped cells 17 of air cell group 10*g*, which is disposed in correspondence to the heel area of the person lying on the air mattress, are shorter than, for example, the bladder-shaped cells 17 of the other air cell groups (10*a* through 10*f*), and the bladder-shaped cells 17 of the other air cell groups 10 extend to the edge of the air mattress. Thus, there is a space left between the bladder-shaped cells 17 of air cell group 10*g*, which corresponds to the heel area, and the edge of the air mattress. The bladder-shaped cells 10*g* disposed in correspondence to the heel area of the person lying on the air mattress are, for example, up to 30% shorter than the bladder-shaped cells 17 of the other air cell groups 10*a* through 10*f*. In other words, in the collection of bladder-shaped cells 17 in which a plurality of bladder-shaped cells is arranged and formed so as to describe a rectangle as a whole when seen in a plan view, out of the four corners thereof, there is a space in one of the corners by the heel area of the person lying on the air mattress in which bladder-shaped cells 17 are not disposed.

An air supply/release pump 11 is disposed within the space in which bladder-shaped cells 17 are not disposed so that the lengthwise direction thereof is, for example, perpendicular with the lengthwise direction of each of the bladder-shaped cells 17; i.e., so that the lengthwise direction is oriented in the direction from the head area to the heel area of the person lying on the air mattress. The air supply/release pump 11 is thereby disposed in a corner out of the four corners of the air mattress 1, which is configured so as to describe a rectangle as a whole when seen in a plan view, that corresponds to the heel area of the person lying on the air mattress. The part corresponding to the side of the heel area is a part that the body of the user of the air mattress does not readily contact even if the user turns over while sleeping, so that sleeping comfort is not reduced. Even if the user does come in contact with this part, because it is the heel, sleeping comfort is not negatively affected by the presence of the pump. By disposing the air supply/release pump 11 in an area within the range of the width and length of the air mattress constituted by the plurality of air cell groups 10, there is no need to dispose the pump 11 externally with respect to the air mattress, and ease of handling is obtained. The height of the air supply/release pump 11 is, for example, equal to or less than that of the bladder-shaped cells 17 of each of the air cell groups 10, creating a configuration in which it is possible to prevent the air supply/release pump 11, which is harder than each of the air-filled bladder-shaped cells 17, from jutting out beyond the air cell groups 10 in the height direction, as well as to prevent the position of the person lying on the air mattress from being higher than that of the side rails when the air mattress is placed on a bed having, for example, side rails. The exterior surface of the air supply/release pump 11 is covered by a pliable member of, for example, urethane, and is configured to simultaneously soften any shocks in case the person on the air mattress or a caretaker or the like comes in contact with the air supply/release pump 11 and protect the air supply/release pump 11.

In the present embodiment, as shown in FIG. 5, the plurality of air cell groups 10 and the air supply/release pump 11 are covered by a single top cover 14 of, for example, nylon fibers coated with polyurethane, and the upper surfaces thereof are protected. Because the upper surfaces of the air cell groups 10 and the air supply/release pump 11 are covered with the top cover 14, the lower surface of the air supply/release pump 11 is exposed to the exterior at one side surface in the widthwise direction of the air mattress 1 and a side surface corresponding to the heel area of the air mattress user in the lengthwise direction of the air mattress 1. When a top cover is provided, as in the case of the present embodiment, the collection of air cell groups formed by the plurality of air cell groups 10 and/or the air supply/release pump 11 is provided with a structure so that the top cover 14 can be fixed thereto, and the air supply/release pump 11 is fixed, for example, to the air cell groups 10.

As shown in FIG. 5, the air supply/release pump 11 is provided on, for example, a side exposed to the exterior on an end of the air mattress 1 in the lengthwise direction with one each of a power input cord, a cord connected to the mattress control circuit 15 for sending and receiving signals with the mattress control circuit 15, and a cord for sending and receiving signals with the hand switch 16 is provided. The hand switch 16 is provided with a switch for switching between various pressures of the air mattress, such as a decubitus ulcer prevention mode in which the amount of air supplied to and released from the bladder-shaped cells 17 connected to the air tubes 13 of, for example, air supply systems system 1, system 2, and system 3 is continuously varied so as to alternatingly inflate and deflate adjacent cells from the shoulder area to the knee area of the person lying on the air mattress, thus preventing a fixed amount of pressure from being placed on a part of the body of the mattress user. The air supply/release pump 11 is driven by power inputted from a power source, and is configured so as to send and receive signals with the mattress control circuit 15 on the basis of directions inputted from the hand switch 16, thereby altering, for example, the rate of rotation of a fan provided within the pump 11, controlling the amount of air supplied to and released from the air tubes 13 of the above seven air supply/release systems and one air release system, and controlling the internal pressure of the bladder-shaped cells 17 connected to the air tubes 13 of each of the air supply systems. Along with the decubitus ulcer prevention mode switch, the hand switch is provided with a transport mode switch for sealing the air release holes so as not to release the air within each of the bladder-shaped cells of the air mattress when, for example, the air mattress is being transported with a person lying thereupon.

In the present embodiment, as shown in FIG. 6, the air tubes 13 are connected to the air supply/release pump 11 using a connector 12. An air supply/release pump-side connector 110 is provided in two locations on, for example, a side of the air supply/release pump 11 in the lengthwise direction opposite to that of the power cord. In the present embodiment, each of the air supply/release pump-side connectors 110 is provided with four air supply/release ports 110*a*; and of the total of eight air supply/release ports 110*a* provided on the air supply/release pump 11, seven are configured as air supply/release ports for supplying and releasing air to and from the bladder-shaped cells connected to the head area, heel area, system 1 through 3, and system A and B via the air tubes 13. The remaining one of the eight air supply/release ports 110*a* is configured as an air supply port, and it is possible to expel air from the plurality of injection holes provided on the outer surface of the air injection tube by supplying air to the air injection tube provided on the lower surface of the mattress, and for moisture to be removed from the mattress. In the present embodiment, as shown in FIG. 7, an air tube-side connector 12 can connect four air tubes; thus, by connecting two air tube-side connectors 12 to the air supply/release pump 11 as shown in FIG. 6, the pressure within the bladder-shaped cells 17 corresponding to the eight air supply/release systems is controlled. FIG. 8(*b*) illustrates an example of a disposition of air intake/release terminals 12*a* corresponding to the eight air supply/release systems.

As shown in FIG. 6, each of the two air supply/release pump-side connectors 110 is provided with four air supply/release ports 110*a*; and by inserting the air intake/release terminals 12*a* of the air tube-side connectors 12 shown in FIG. 7 into the air supply/release ports 110*a* and engaging a projection on a side of a connector cover 12*b* with an indentation on interior surfaces of the air supply/release pump-side connectors 110, the air tube-side connectors 12 are mated with the air supply/release pump-side connectors 110. Rubber seals 12*c* are provided on exterior surfaces of the air intake/release terminals 12*a* of the air tube-side connectors 12, increasing the strength of the seal between the air supply/release ports 110*a* and the air intake/release terminals 12*a*.

The present embodiment is configured so that, when the connectors 12 are removed from the air supply/release pump 11 as shown in FIG. 9, the connections between all of the air tubes 13 and each of the eight air supply/release systems are released, thus releasing control of the pressure within the bladder-shaped cells, and the air within all of the bladder-shaped cells is rapidly released through the air tubes 13 of each of the air supply/release systems.

As shown in FIG. 9(*a*) and FIG. 9(*b*), the connector 12 of the present embodiment is configured so that front ends of the connector covers 12*b* project in directions facing towards each other; and when rear ends of the connector covers 12*b* are pressed in directions approaching each other, the projecting tips of the connector covers 12*b* press upon the surface upon which the air supply/release ports of the air supply/release pump-side connectors 110 are provided (the mating surface), as shown in FIG. 9(*b*), at the same time that the projections on the sides of the connector covers 12*b* and the indentations on the inner surface of the air supply/release pump-side connector 110 disengage; and is configured so that the connector can be easily detached.

The mattress control circuit 15 is provided, for example, to the exterior of the hand switch 16 and the air supply/release pump 11, and is connected to each of the hand switch 16 and the air supply/release pump. In the present embodiment, the mattress control circuit 15 controls air supply/release by the air supply/release pump 11 to each of the air cell groups 10, and performs a control so that the pressure within each of the bladder-shaped cells 17 becomes a predetermined target value for each of the air supply/release systems. The mattress control circuit 15 is configured so as to begin supplying air using the air supply/release pump 11 to each of the air supply systems when the difference between the value measured by the pressure sensor provided for each of the systems and the set target value is 5% or more for a period of four seconds or longer, and to stop supplying air using the air supply/release pump 11 when the value measured by the pressure sensor becomes the set target value or greater.

Next, the operation of the air mattress according to the present embodiment will be described. In the present embodiment, when, for example, a switch of the hand switch 16 is operated, an input signal from the hand switch 16 is first inputted to the mattress control circuit 15 via the cord on the end of the air supply/release pump. The mattress control circuit 15 then controls, for example, the rate of rotation of the fan within the air supply/release pump 11 on the basis of the received signal. The amount of air supplied and released to and from the air tubes 13 connected to each of the air supply/release systems of the air supply/release pump is thereby controlled, in turn controlling the pressure within the bladder-shaped cells 17 connected to the air tubes 13 of each of the air supply systems.

At this time, the mattress control circuit 15 controls the pressure within the bladder-shaped cells corresponding to each of the air tubes 13 connected, for example, to the four block control air supply systems, except for those in the air cell group 10*g* corresponding to the heel area, so that the pressure is constantly at a fixed amount. The pressure in the air cell group 10*g* corresponding to the heel area is controlled so as to inflate or deflate within a predetermined pressure range at a fixed interval. In other words, when the body weight of the person lying on the air mattress is, for example, from 30 to 135 kg, each of the air cell groups is separately controlled so that the pressure within the bladder-shaped cells of air cell group 10*a*, which corresponds to the person's head area, is, for example, from 1.6 to 4.3 kPa; the pressure within the bladder-shaped cells of air cell group 10*g*, which corresponds to the person's heel area, is, for example, from 1.1 to 3.0 kPa; the pressure within the bladder-shaped cells of the lower sections of air cell group 10*c* and 10*e* (system A), which correspond to the person's back area and thigh area, is from 1.5 to 6.4 kPa; and the pressure within the bladder-shaped cells of the lower section of air cell group 10*d* (system B), which corresponds to the person's buttock area, is from 1.1 to 3.3 kPa. By controlling the pressure within the bladder-shaped cells of the air cell group 10*a* corresponding to the head area of the person lying on the air mattress so that the pressure is a fixed amount, it is possible to stably support the locations corresponding to a bone protruding outward from the back area of the body of the mattress user (the occipital bone) when the user is in a reclined state. By controlling the pressure within the bladder-shaped cells of the lower sections of air cell group 10*c* and 10*e* (system A), which correspond to the back area and thigh area of the person, so as to be greater than the pressure within the bladder-shaped cells of the lower section of air cell group 10*d* (system B), which corresponds to the buttock area, it is possible to stably support the buttock area, which protrudes toward the mattress and thus receives a larger load of the body's weight compared to other locations when the user is in a reclined state, from both sides, i.e., using the bladder-shaped cells of air cell group 10*c* and 10*e*, which correspond to the back area and the thigh area; this in turn enables the promotion of body pressure dispersion and the prevention of the repelling force placed by the air mattress on the buttock area of the person on the air mattress from becoming too great and decubitus ulcers from occurring. Furthermore, by inflating or deflating the air cell group 10*g* corresponding to the heel area at a fixed interval, it possible to switch the part supporting the heel area between the thigh and the heel at a fixed interval, preventing repelling force from the mattress being placed upon the heel of the person for long periods of time.

Here, the mattress control circuit 15 performs a control in particular for the air cell groups 17*c* through 17*e*, for which air intake/release is performed via system A and system B, so that the internal pressure in the lower section bladder-shaped cells 17*c* is greater than that in the upper section and middle section bladder-shaped cells 17*a*, 17*b*. The repelling force placed by the mattress on the person is thereby reduced by the upper section and middle section bladder-shaped cells 17*a*, 17*b*, which have a pressure smaller than that of the lower section bladder-shaped cells 17*c*, while the lower section bladder-shaped cells 17*c* stably support the person; and it is further possible to soften the contact feel felt by the person using the upper section bladder-shaped cells 17*a*, so that there is no reduction in sleeping comfort for the person lying on the air mattress.

Figure 10:
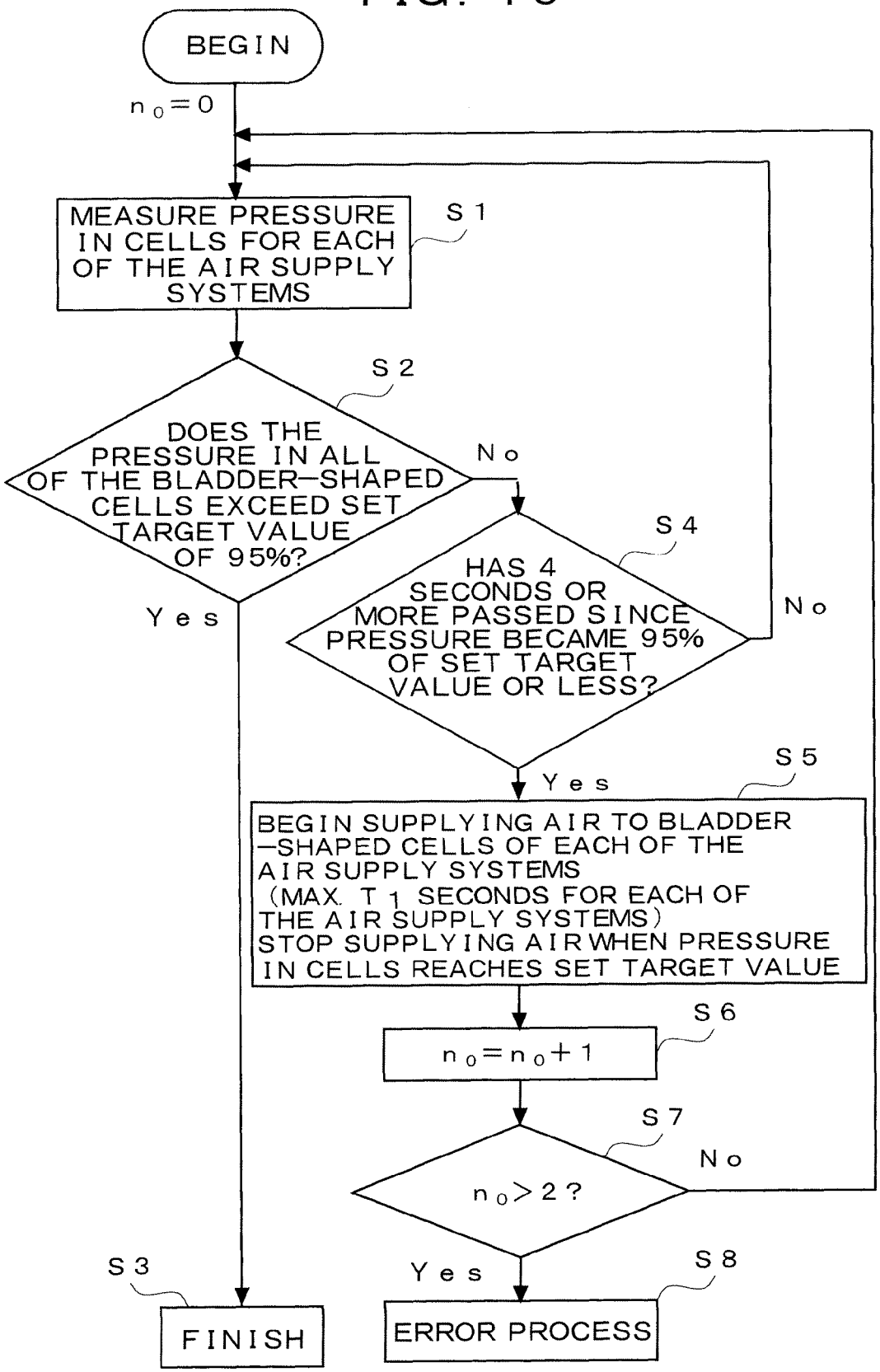
FIG. 10 is a flow chart illustrating a process of setting the internal pressure of the bladder-shaped cells of each of the systems in the air mattress according to the embodiment of the present invention.

Next, the control of internal pressure by the mattress control circuit 15 in the air mattress according to the present embodiment will be described. When the pressure within the bladder-shaped cells connected to each of the air supply systems is adjusted, the mattress control circuit 15 performs pressure control according to, for example, the flow chart shown in FIG. 10. At the time when pressure control is begun, the initial value for an interval count $n_0$ is 0. First, the pressure within the bladder-shaped cells is measured by the pressure sensors provided for each of the air supply systems (step S1). Next, the mattress control circuit 15 determines whether or not the pressure within all of the bladder-shaped cells exceeds a set target value of 95% or not (step S2). At this time, if the pressure within each of the bladder-shaped cells exceeds the set target value of 95%, the mattress control circuit 15 finishes pressure control (step S3). On the other hand, if there is even one bladder-shaped cell whose internal pressure is equal to or less than the set target value of 95%, the mattress control circuit 15 measures the period for which the difference between the value measured by the pressure sensor and the set target value was 5% or greater (step S4). The mattress control circuit 15 then determines whether the measured period was equal to or greater than four seconds. If the period for which a bladder-shaped cell was present in which the difference between the value measured by the pressure sensor and the set target value was 5% or greater was less than four seconds, the process returns to step S1. On the other hand, if the period for which a bladder-shaped cell was present in which the difference between the value measured by the pressure sensor and the set target value was 5% or greater was four seconds or longer, the mattress control circuit 15 begins supplying air using the air supply/release pump 11 to each of the air supply/release systems in order (step S5). For example, if the pressure within the bladder-shaped cells 17 connected to the air supply system B decreases, and the difference with the predetermined set target value is 5% or greater for a period of four seconds or more, the mattress control circuit 15 supplies air to each of the bladder-shaped cells of system B. Alternatively, even if, for example, the pressure within the bladder-shaped cells 17 connected to the air supply system B is equal or greater than the set target value of 95% when the period is being measured, if, for example, the pressure within the bladder-shaped cells 17 connected to the air supply system A decreases and a state in which the difference with the set target value is 5% or more continues, the mattress control circuit 15 continues to measure the period. If the pressure within all of the bladder-shaped cells exceeds the set target value of 95% before the continuously measured period reaches four second, period measuring is finished, and the process returns to step S1.

The air supply period $t_1$ for each of the air supply systems is set at, for example, 60 seconds, and when the internal pressure of the bladder-shaped cells to which air is being supplied becomes the set target value or greater during the air supply period $t_1$, air supply using the air supply/release pump 11 is stopped for that system, and air supply to the next system is begun. When the internal pressure of the bladder-shaped cells to which air is being supplied does not become the set target value or greater during the predetermined air supply period $t_1$, air supply is stopped for that system, and air supply to the next system is begun. When air supply to all of the systems is finished, the interval count $n_0$ is increased by 1

(step S6). The mattress control circuit 15 then repeats pressure control for a maximum of two intervals, with the series of operations from step S1 through step S6 counted as one interval. The numerical value for the interval count $n_0$ is determined every interval (step S7). When the interval count $n_0$ exceeds 2, an error process is performed by, for example, displaying a message on a monitor of the hand switch 16 that the pressure control state of the mattress is abnormal (step S8).

In this way, the mattress control circuit 15 of the air mattress according to the present embodiment measures the pressure in each of the systems and supplies air thereto, and stops supplying air using the air supply/release pump 11 when the value measured by the pressure sensor becomes the set target value or greater. Thus, in the mattress according to the present embodiment, setting to a predetermined pressure value is performed more quickly than in cases where air is supplied to all of the bladder-shaped cells, and responsiveness is greater.

There now follows a description of the operation of each of the air supply systems in the air mattress according to the present embodiment when a decubitus ulcer prevention function is operated. When a decubitus ulcer prevention function of the air mattress is operated, the mattress control circuit 15 first, as shown for example in FIG. 11, performs a control of the three alternating inflation/deflation air supply systems so that air is supplied to air supply system 1 and released from air supply system 2. Neither air supply nor air release is performed upon air supply system 3. The pressure within the bladder-shaped cells 17 linked to the air tube of system 2 thereby becomes the smallest, and the pressure within the bladder-shaped cells 17 linked to the air tube of system 1, which until just previously had been the smallest, becomes roughly equal to the pressure within the bladder-shaped cells 17 linked to the air tube of system 3. Air supply/release is not performed for systems A and B, or for the air supply systems for the head area and heel area. At this time, the mattress control circuit 15 controls the amount of air supplied to each of the systems on the basis of the values measured by the pressure sensors as appropriate, and sets the internal pressure of the bladder-shaped cells 17 of each of the systems to the predetermined set target value.

In this case, the mattress control circuit 15 performs a control so that the air supply period for the air supply systems out of alternating inflation/deflation systems 1 through 3 being inflated is, for example, a maximum of 170 seconds, the air release period for systems being deflated is, for example, a maximum of 120 seconds, and air release from system 2 is performed, for example, after a predetermined period from the beginning of air supply to system 1. Because air release is thus performed on system 2 after the bladder-shaped cells 17 linked to the air tube of system 1 are inflated until the internal pressure thereof becomes the set target value or greater, the supporting capability of the mattress is not reduced. Then, when the air supply period for system 1 and the air release period for system 2 are finished, the pressure within, for example, the bladder-shaped cells of each of the air supply systems is held at a fixed level. This pressure holding period is, for example, 120 seconds, and if, between the pressure maintenance period and the air supply/release operation periods for the systems 1 through 3, the pressure within, for example, system A and system B decreases, and the difference between the value measured by the pressure sensors provided in system A and system B and the set target value is 5% or more for a period of four seconds or longer, the mattress control circuit 15 performs air supply using the air supply/release pump 11 to system A and system B in that order, as shown in FIG. 6, and stops supplying air using the air supply/release pump 11 when the pressure within the bladder-shaped cells 17 becomes the set target value or greater. The pressure within the bladder-shaped cells of system A and system B thereby becomes the set target value or greater.

Figure 11:
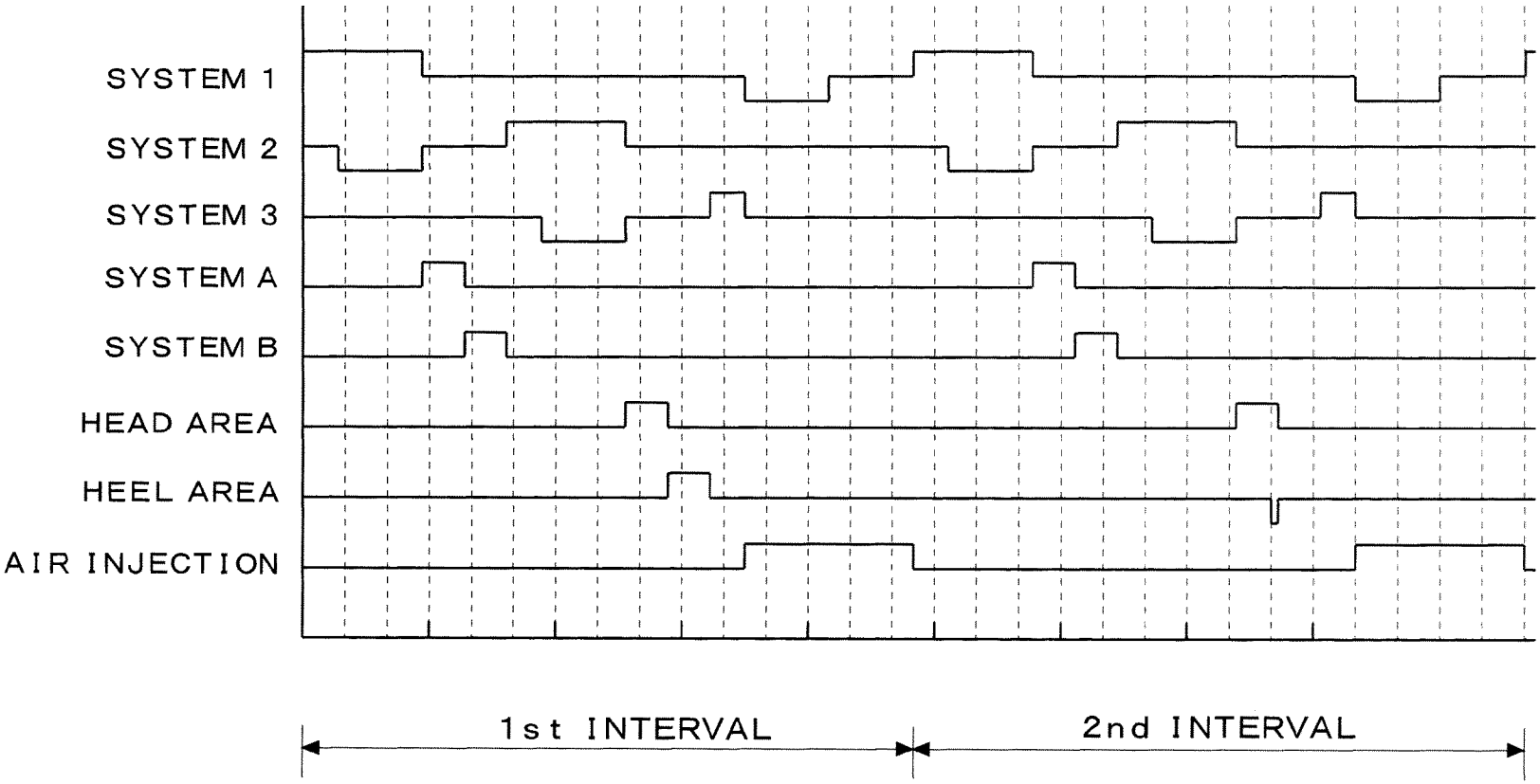
FIG. 11 chronologically illustrates the operation of each of the air supply/release systems when a decubitus ulcer prevention function of the air mattress according to the embodiment of the present invention is operated.

Next, as shown in FIG. 11, the mattress control circuit 15 performs a control so as to supply air to air intake system 2 and release air from air intake system air supply system 3. Neither air supply nor air release is performed upon air supply system 1. The pressure within the bladder-shaped cells 17 linked to the air tube of system 3 thereby becomes the smallest, and the pressure within the bladder-shaped cells 17 linked to the air tube of system 2, which until just previously had been the smallest, becomes roughly equal to the pressure within the bladder-shaped cells 17 linked to the air tube of system 1. Air supply/release is not performed for systems A and B, or for the air supply systems for the head area and heel area.

Next, similar control is performed so that after, for example, a pressure holding period of 120 seconds, air is supplied to the air supply system 3, and air is released from the air supply system 1. Neither air supply nor air release is performed upon air supply system 2. One interval of the series of air supply/release operations for systems 1 through 3 is thus completed. During this interval of air release operations, air injection from the air injection tube is performed at the same time that air release from system 1 finishes.

By controlling the pressure within the bladder-shaped cells connected to the air tubes 13 of each of the air supply/release systems as described above, it is possible to alternatingly inflate and deflate the pressure within the bladder-shaped cells of the air cell groups 10 corresponding to the soft parts where the skin contacts the surface of the mattress, i.e., the shoulder area, back area, buttock area, thigh area, and knee area of a person when the person is in a reclined state, thereby preventing the same amount of pressure from being placed on specific parts of the skin for long periods of time, and thus decubitus ulcers from occurring.

At the same time, the pressure within the systems for which air supply/release operations are not performed is also measured for each of the systems by the pressure sensors, and when the internal pressure value is less than the set target value, air is supplied using the air supply/release pump 11 after a predetermined period. It is thus possible to easily set the pressure within the bladder-shaped cells of each of the systems to a predetermined target pressure value.

Figure 12:
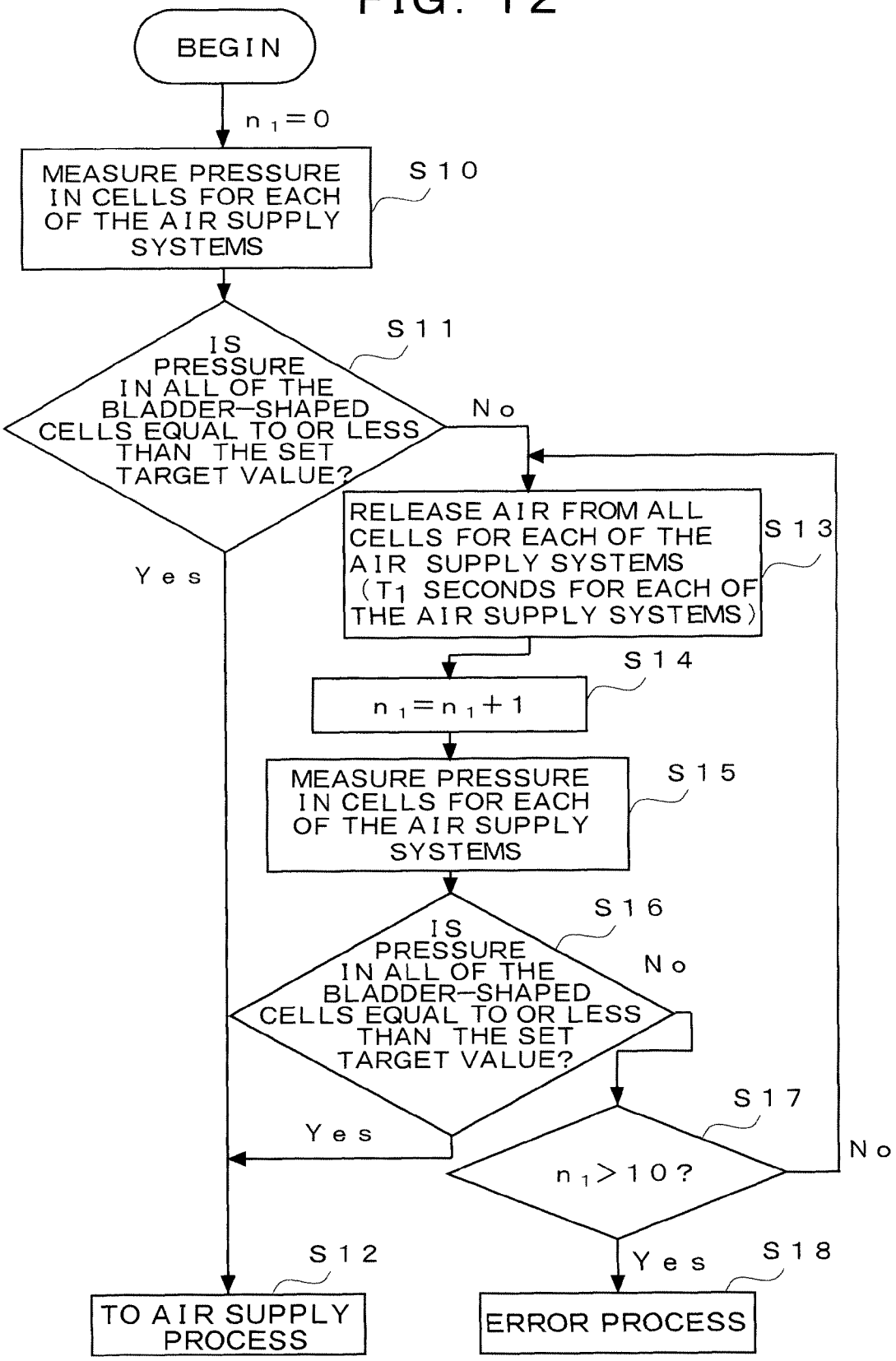
FIG. 12 is a partial flow chart illustrating a process of setting the internal pressure of the bladder-shaped cells of each of the systems when transitioning between modes in the air mattress according to the embodiment of the present invention.
Figure 13:
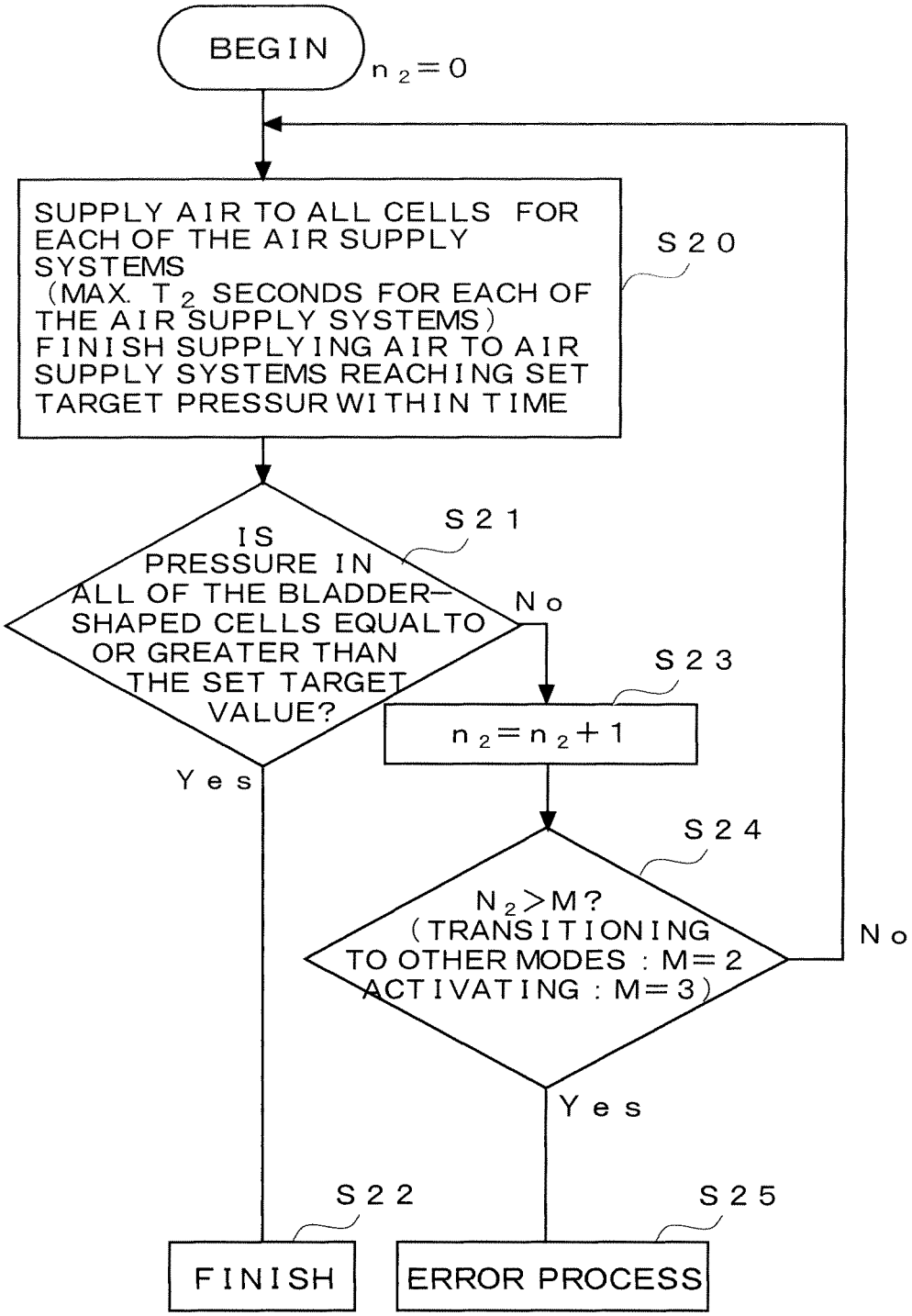
FIG. 13 is a partial flow chart illustrating a process of setting the internal pressure of the bladder-shaped cells of each of the systems when transitioning between modes in the air mattress according to the embodiment of the present invention, and illustrates the process of step 12 and afterward from FIG. 12.
Figure 14:
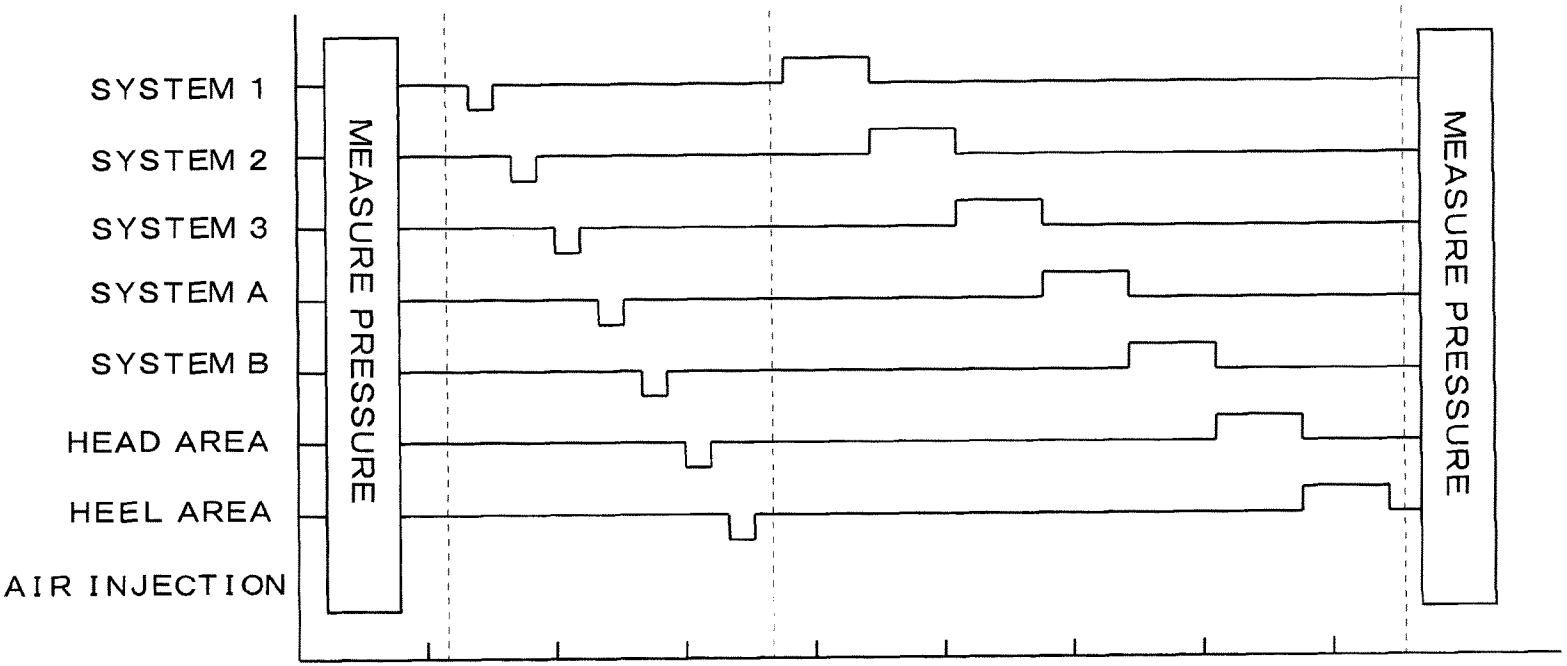
FIG. 14 chronologically illustrates the operation of individual air supply systems for the bladder-shaped cells in each of the systems when transitioning between modes.

Next, the operation of the air mattress according to the present embodiment when transitioning between modes due to, for example, the hand switch 16 being operated will be described. FIG. 12 and FIG. 13 are flow charts showing a process of setting the internal pressure for the bladder-shaped cells of each of the systems of the air mattress according to the embodiment of the present invention when transitioning between modes, and FIG. 14 chronologically illustrates the operation of each of the air supply systems for the bladder-shaped cells of each of the systems when transitioning between modes. In the present embodiment, "mode transition" refers to when the power of the air mattress is turned on and to when a decubitus ulcer prevention function is begun.

When the power of the air mattress is turned on, and in the decubitus ulcer prevention function, for example, the power is turned on or decubitus ulcer prevention function operation is begun by the hand switch 16 being operated. When this happens, the pressure within the bladder-shaped cells 17 is first measured by the pressure sensors provided for each of the air supply systems (step 10). The initial value for an interval count $n_1$ is 0. Next, the mattress control circuit 15 determines whether or not the pressure within the bladder-shaped cells of all of the systems is equal to or less than the set target value on the basis of the values measured by the pressure sensors (step S11). When the pressure within the bladder-shaped cells of all of the systems is equal to or less than the set target value, the procedure shifts to the air supply process (step S12). On the other hand, if there is even one system in which the pressure within the bladder-shaped cells exceeds the set target value, air is released from all of the bladder-shaped cells for each of the systems (step S13, first half of FIG. 13), and the interval count $n_1$ increases by 1 (step S14). The air release time for each of the air supply systems is $t_1$ (for example, from 10 to 50 seconds). Next, the pressure within the cells is measured for each of the air supply systems (step S15). Then, the mattress control circuit 15 determines whether or not the pressure within the bladder-shaped cells of all of the systems is equal to or less than the set target value on the basis of the values measured by the pressure sensors (step S16). When the pressure within the bladder-shaped cells of all of the systems is equal to or less than the set target value, the procedure shifts to the air supply process (step S12). When there is even one system in which the pressure within the bladder-shaped cells is equal to or greater than the set target value, the procedure returns to the operations of step S13 through step S16, and the air release operation is performed for a maximum of ten intervals, with the series of operations from step S13 through step S16 being considered one interval. The size of the interval count $n_1$ is then determined (step S17), and when the interval count $n_1$ exceeds 10, an error process is performed by, for example, displaying a message on a monitor of the hand switch 16 that the pressure control state of the mattress is abnormal (step S18).

If transition to the air supply process is successfully performed in step S12, air is supplied according to the flow chart of FIG. 13. The initial value for an interval count $n_2$ is 0. When this happens, air is first supplied to all of the bladder-shaped cells in each of the systems (step S20, latter half of FIG. 14). The air supply time is a maximum of $t_2$ seconds (for example, air mattress activation time: 300 seconds; transition time to decubitus ulcer prevention function or the like: 60 seconds). The mattress control circuit 15 then determines whether the pressure within all of the bladder-shaped cells is equal to or greater than the set target value (step S21). When the pressure within all of the bladder-shaped cells is equal to or greater than the set target value, the air supply process is finished (step S22). On the other hand, if there is even one system in which the pressure within the bladder-shaped cells is less than the set target value, the interval count $n_2$ is increased by 1 (step S23), and the procedure returns to step S20. The air supply operation is then repeated for a maximum of m intervals (for example, when activating the air matter: m=3; when transitioning to a decubitus ulcer prevention function or the like: m=2), with the series of operations from step S20 through step S21 being considered one interval. The size of the interval count $n_2$ is then determined (step S24), and when the interval count $n_2$ exceeds m, an error process is performed by, for example, displaying a message on a monitor of the hand switch 16 that the pressure control state of the mattress is abnormal (step S25). Using the above process, it is possible in the present embodiment to rapidly set the pressure within each of the bladder-shaped cells with reference to a set target value even when transitioning between modes. Specifically, because air is supplied to each of the systems after the pressure within all of the bladder-shaped cells is set smaller than the set target value, and air supply to systems in which the internal pressure value has become the set target value or greater is finished in order, the pressure value for each of the systems is rapidly set in order to the set target value or greater.

In the present embodiment, as described above, each of the air cell groups is disposed in correspondence with the locations of the body of a person, and air supply to each of the air cell groups can be performed in independent systems and pressure controlled. Moreover, each of the air cell groups corresponding to the back area, buttock area, and thigh area of the person is formed so as to have an upper section, a middle section, and a lower section; the upper section bladder-shaped cells and the middle section bladder-shaped cells communicating with each other, and pressure control capable of being performed for each of the upper section and middle section bladder-shaped cells in independent systems. It is thereby possible not only to control pressure according to the location of the body of the person lying on the air mattress, but also, in the air cells groups corresponding to the head area, buttock area, and thigh area, to reduce the repelling force placed by the mattress upon the person using the upper section and middle section bladder-shaped cells, which have a pressure smaller than that of the lower section bladder-shaped cells, while the lower section bladder-shaped cells stably support the person, and further to soften the contact feel felt by the person using the upper section bladder-shaped cells. Thus, in the air mattress according to the present embodiment, the sleeping comfort of the person lying on the air mattress is not reduced.

The mattress control circuit 15 also measures the pressure in each of the systems and supplies air thereto, and stops supplying air using the air supply/release pump 11 when the value measured by the pressure sensor becomes the set target value or greater. Thus, in the mattress according to the present embodiment, setting to a predetermined pressure value is performed more quickly than in cases where air is supplied to all of the bladder-shaped cells, and responsiveness is greater.

Also, even when transitioning between modes, such as when activating the air mattress or starting the decubitus ulcer prevention function, because the mattress control circuit 15 supplies air to each of the systems after the pressure within all of the bladder-shaped cells is set smaller than the set target value, and finishes supplying air to systems in which the internal pressure value has become the set target value or greater in order, it is possible to set the pressure value for each of the systems in order to the set target value or greater.

Figure 16:
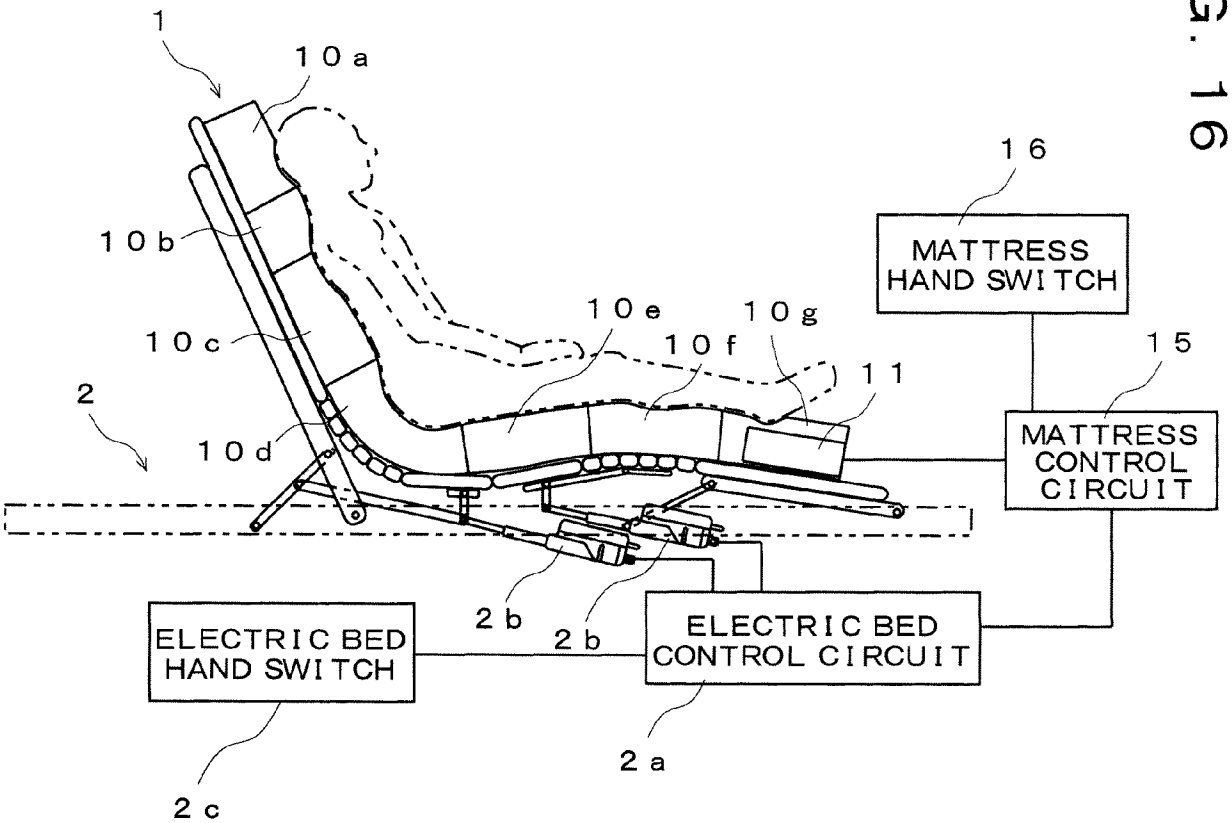
FIG. 16 is a schematic view of an air mattress according to an embodiment of the present invention laid upon a back frame of an electric bed.

Next, an air mattress according to a third embodiment of the present invention will be described. As shown in FIG. 16, an air mattress 1 according to a second embodiment is laid upon a frame of a bed 2 having a raisable back frame and used. The bed 2 according to the present embodiment is an electric bed, and is configured so that a piston rod on the tip of an actuator 2*b* is made to advance or retract on the basis on input from a hand switch 2*c*, thereby raising or lowering the back in connection with various linkage mechanisms of the bed coupled to the tip of the piston rod.

In the present embodiment, the mattress control circuit 15 is connected to the control circuit 2*a* of the electric bed 2, and the back raising angle of the back frame is input as a signal via, for example, the control circuit 2*a* of the electric bed. It is configured to then control, for example, the rate of rotation of the fan for each of the air supply/release systems of the air supply/release pump 11 according to the back raising angle on the basis of the back raising angle signal so that, for example, a predetermined pressure value is obtained, thus controlling the pressure within each of the bladder-shaped cells connected to the eight air supply/release systems. The rest of the configuration is identical to that of the first embodiment.

Next, the operation of the air mattress according to the present embodiment will be described. In the present embodiment, when the bed hand switch 2*c* of the electric bed 2 is operated, a command from the bed hand switch is first inputted to the control circuit 2*a* of the electric bed 2. The electric bed control circuit 2*a* then decides the distance to advance or retract the piston rod on the tip of the actuator 2*b* according to the signal from the bed hand switch, thereby deciding the back raising angle of the back frame. Next, the electric bed control circuit 2*a* sends the signal regarding the back raising angle of the back frame to the mattress control circuit 15. The mattress control circuit 15 thereby decides the optimal pressure for each of the bladder-shaped cells connected to each of the air supply/release systems according to the inputted back raising angle signal. At this time, the mattress control circuit 15 controls the internal pressure of each of the bladder-shaped cells 17 linked to each of the air supply/release systems so that, for example, the pressure in air cell groups 10*c*, 10*e*, corresponding to the back area and thigh area, is higher than the pressure within air cell group 10*d*, corresponding to the buttock area, and furthermore so that the pressure within the air cell group 10*d* corresponding to the buttock area increases as the angle to which the back frame is raised increases.

Figure 15:
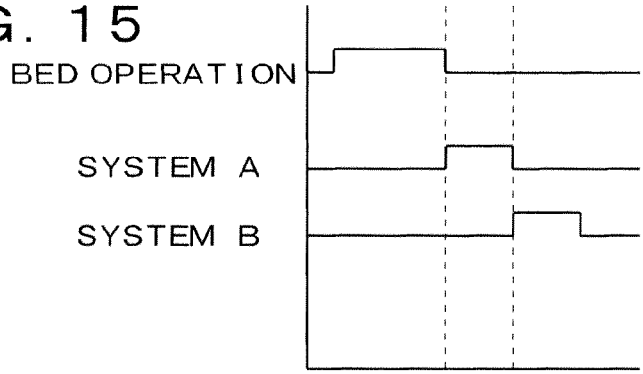
FIG. 15 illustrates an operation of supplying and releasing air to and from a system A and a system B in an air mattress according to a second embodiment of the present invention.

Next, the electric bed control circuit 2*a* operates the actuator 2*b* by, for example, supplying power to the actuator 2*b*, and the back frame is raised. In the present embodiment, as shown in FIG. 15, when the operation of raising the back of the bed is stopped and the back raising angle is secured, the mattress control circuit 15 first begins supplying air to air supply system A, and sets the pressure within the bladder-shaped cells connected to system A to the set target value. Next, the mattress control circuit 15 begins supplying air to air supply system B, and sets the pressure within the bladder-shaped cells connected to system B to the set target value. The mattress control circuit 15 subsequently sets the pressure within the bladder-shaped cells of each of the systems to the set target value according to, for example, the process shown in FIG. 12 through FIG. 14, then transitions to the normal pressure adjustment mode shown in FIG. 10.

In the present embodiment, the internal pressure of the bladder-shaped cells of each of the systems is set to an optimal value when the back frame of the electric bed 2 has been raised or lowered so as to have a predetermined back raising angle. The value set for the internal pressure of the bladder-shaped cells is a pressure such that the body weight of the person on the air mattress is dispersed evenly over the mattress, and, for example, large localized pressure is not placed upon the mattress user and the mattress user does not feel as though there is a foreign object present or experience other types of discomfort; and is set to a value experienced in experiments or the like. In the present embodiment as well, internal pressure is controlled in a manner similar to that of, for example, the first embodiment. Control is also performed so that the internal pressure of the bladder-shaped cells in air cell groups 10*c*, 10*e* (system A) corresponding to the back area and thigh area of the person is greater than the internal pressure of the bladder-shaped cells in air cell group 10*d* (system B) corresponding to the buttock area. The pressure within air cell groups 10*c*, 10*e* corresponding to the back area and thigh area is also controlled so that the pressure within each of the air cells increases as the angle to which the back frame is raised increases.

In the present embodiment, the mattress control circuit 15 performs a control so that the pressure in the air cell groups supporting the back area and thigh area of the person lying on the air mattress 1 (air cell groups 10*c* and 10*e*, respectively) increases when the back frame of the bed is in a raised state. It is thereby possible, in addition to the effects of the first embodiment, to stably support the buttock area of the person on the air mattress from both sides thereof using the air cell groups supporting the back area and thigh area of the person even when the back frame of the bed has been raised. It is also possible to prevent a large localized pressure from being placed upon the air mattress 1 corresponding to the buttock area of the person and mattress compression, in which that part of the air mattress 1 corresponding to the buttock area of the person is compressed and greatly caves in, from occurring even when the back frame of the bed is raised, as well as to stably support the mattress user.

In the present embodiment, because it is not the pressure in the air cell group 10*d* supporting the buttock area of the person lying on the air mattress 1, but rather the pressure in the air cell groups (10*c* and 10*e*, respectively) supporting the back area and thigh area on both sides of the buttock area, that is increased when the back frame is raised, it is possible to effectively distribute body pressure using the air mattress without the repelling force from the air mattress placed upon the buttock area of the area increasing and comfort being reduced.

Furthermore, in the present embodiment, because the mattress control circuit 15 controls the pressure of each of the air cell groups so that the pressure within the air cell group 10*d* corresponding to the buttock area increases as the angle to which the back frame is raised increases, it is possible to obtain the effects described above regardless of the back raising angle.

It is also possible in the present embodiment to obtain an air mattress configured so that the pressure within each of the bladder-shaped cells is continuously altered when the back frame of the bed 2 is raised.

It is also possible to obtain the effects described above regardless of the body weight of the person lying on the air mattress by configuring the air mattress of the present embodiment as described below. Specifically, a configuration is adopted in which body weight can be inputted into the hand switch 16, and control is performed so that the mattress control circuit 15 increases the pressure within each of the air cell groups the greater the body weight of the person. By configuring the air mattress in this way, it is possible to prevent mattress cave-in at, for example, a position corresponding to the buttock area from being larger, for example, in the case of a person with a high body weight than in the case of a person with a low body weight.

In this case, a configuration may also be adopted in which a load sensor is provided at each of the four corners of the bed upon which the air mattress is laid, the body weight of the person on the air mattress is detected by these load sensors, and the body weight of the person on the mattress as detected by the load sensors is inputted to the mattress control circuit 15 via the control circuit 2*a* of the electric bed.

INDUSTRIAL APPLICABILITY

The present invention is useful in improving the sleeping comfort of an air mattress.

KEY

1 air mattress
10 air cell group
11 air supply/release pump
110 connector (air supply/release pump-side)
110*a* air supply/release ports
12 connector (air tube-side)
12*a* air supply/release terminal
12*b* connector cover

12*c* rubber seal
13 air tube
14 top cover
15 mattress control circuit
16 hand switch
17 bladder-shaped cell
17*a* upper section bladder-shaped cell
17*b* middle section bladder-shaped cell
17*c* lower section bladder-shaped cell
2 electric bed
2*a* electric bed control circuit
2*b* actuator
2*c* electric bed hand switch
23 load sensor

The invention claimed is:

1. An air mattress, comprising:

a plurality of air cell groups lined up in a lengthwise direction of the air mattress, each of which groups is constituted by a plurality of bladder-shaped cells;

an air supply/release pump;

an air tube of a first system for connecting bladder-shaped cells of partial air cell groups out of said air cell groups to said air supply/release pump in one or a plurality of independent systems by assembling the bladder-shaped cells belonging to the air cell groups thereof all together;

an air tube of a second system for connecting bladder-shaped cells of the remaining air cell groups out of said air cell groups to said air supply/release pump in a plurality of independent systems in common for every one of the the plurality of bladder-shaped cells;

a pressure sensor for measuring the pressure within said bladder-shaped cells for each system of said first system and said second system; and a controller for controlling air supply/release by the air supply/release pump with respect to each system of said first system and second system;

wherein said plurality of air cell groups is lined up corresponding to at least a head area, shoulder area, back area, buttock area, thigh area, knee area, and heel area of a person lying on said air mattress, wherein the air cell groups corresponding to at least said back area, buttock area and thigh area out of said plurality of air cell groups are specific air cell groups each of which comprises an upper section, a middle section, and a lower section, wherein air cell groups other than the specific air cell groups are non-specific air cell groups each of which is constituted by one section, and wherein the air cell groups at the lower section of said specific air cell groups and the the plurality of air cell groups out of said non-specific air cell groups are supply/release controlled for each of the systems of said first system, the air cell groups at the upper and middle sections of said specific air cell groups and the remaining air cell groups of said non-specific air cell groups are supply/release-controlled for each of the systems of said second system, and the upper section bladder-shaped cells of said specific air cell groups communicate with the middle section bladder-shaped cells therebeneath.

2. The air mattress according to claim 1, wherein at least a side surface of each of said upper section and middle section bladder-shaped cells is formed in an arcuate shape, and the radius of curvature of the arcuately shaped parts of said upper section bladder-shaped cells is smaller than the radius of curvature of the arcuately shaped parts of said middle section bladder-shaped cells.

3. The air mattress according to claim 1, wherein said controller performs a control so that the pressure in said lower section bladder-shaped cells is greater than that in said middle section bladder-shaped cells.

4. The air mattress according to claim 1, wherein said controller performs a control so that the pressure in at least the air cell groups corresponding to the head area of said person lying on said air mattress out of said air cell groups is maintained at a fixed level, the bladder-shaped cells of the air cell groups corresponding to the heel area are inflated or deflated at a fixed interval, and the pressure in the air cell groups corresponding to said back area and thigh area is greater than the pressure in the air cell groups corresponding to the buttock area.

5. The air mattress according to claim 4, wherein:

the bladder-shaped cells of the air cell groups corresponding to said head area and heel area, as well as the lower section bladder-shaped cells of the air cell groups corresponding to said back area, buttock area, and thigh area, are connected to said first system via said air tube; and in order to set the pressure within the bladder-shaped cells to which air is supplied by said first system to a set target value, said controller begins supplying air using said air supply/release pump to the system when the value measured by said pressure sensor is reduced below said set target value and a period during which the difference between the measured value and the set target value is 5% or more is four seconds or more, and stops supplying air using said air supply/release pump when the value measured by said pressure sensor becomes equal to or greater than said set target value.

6. The air mattress according to claim 4, wherein said second system comprises two or more systems;

each of the bladder-shaped cells in the air cell groups corresponding to said shoulder area and knee area, as well as the upper section bladder-shaped cells in the air cell groups corresponding to said back area, buttock area, and thigh area, is connected to one of said systems of said second system via said air tubes; and a control can be performed so that inflation and deflation can be repeated in order within each of the air cell groups for each of the systems.

7. The air mattress according to claim 2, wherein said controller performs a control so that the pressure in said lower section bladder-shaped cells is greater than that in said middle section bladder-shaped cells.

8. The air mattress according to claim 5, wherein said second system comprises two or more systems;

each of the bladder-shaped cells in the air cell groups corresponding to said shoulder area and knee area, as well as the upper section bladder-shaped cells in the air cell groups corresponding to said back area, buttock area, and thigh area, is connected to one of said systems of said second system via said air tubes; and a control can be performed so that inflation and deflation can be repeated in order within each of the air cell groups for each of the systems.

9. The air mattress according to claim 1, wherein the controller controls air supply/release such that the pressure within each of said bladder-shaped cells is variable.

10. The air mattress according to claim 1, wherein the plurality of air cell groups, the air supply/release pump, the air tube of the first system, and the air tube of the second system constitute an integrated whole.

11. The air mattress according to claim 1, wherein each of the bladder-shaped cells of the plurality of air cell groups comprises a rod-shaped cell extending in a widthwise direction of the air mattress.

12. The air mattress according to claim 1, wherein said plurality of air cell groups corresponding to said heel area have a shorter length in a widthwise direction of the air mattress than said plurality of air cell groups corresponding to the head area, shoulder area, back area, buttock area, thigh area, and knee area.

13. The air mattress according to claim 1, wherein said plurality of air cell groups corresponding to the head area, shoulder area, back area, buttock area, thigh area, and knee area extend from one perimeter to the other perimeter in a widthwise direction of the air mattress.

14. The air mattress according to claim 1, wherein said air supply/release pump is disposed in an area corresponding to said heel area.

15. The air mattress according to claim 1, wherein said air supply/release pump is disposed in a corner of the air mattress, and disposed in an area corresponding to said heel area.

16. The air mattress according to claim 1, wherein said air supply/release pump is provided on a side of said air mattress exposed to the exterior on an end of said air mattress in the lengthwise direction.

17. The air mattress according to claim 1, further comprising:

a top cover fixed to an upper surface of said plurality of air cell groups, wherein the top cover comprises nylon fibers coated with polyurethane.

* * * * *